US007427467B2

(12) United States Patent
Teranishi

(10) Patent No.: US 7,427,467 B2
(45) Date of Patent: Sep. 23, 2008

(54) SILVER SALT PHOTOTHERMOGRAPHIC DRY IMAGING MATERIAL

(75) Inventor: Miyuki Teranishi, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/407,124

(22) Filed: Apr. 19, 2006

(65) Prior Publication Data

US 2006/0240367 A1 Oct. 26, 2006

(30) Foreign Application Priority Data

Apr. 26, 2005 (JP) ..... 2005-127672
Nov. 22, 2005 (JP) ..... 2005-336787

(51) Int. Cl.
*G03C 1/76* (2006.01)
*G03C 1/498* (2006.01)

(52) U.S. Cl. ..... 430/523; 430/525; 430/529; 430/619; 430/631; 430/950

(58) Field of Classification Search ..... 430/631, 430/619, 950, 523, 529, 525
See application file for complete search history.

(56) References Cited

U.S. PATENT DOCUMENTS

| | | | | |
|---|---|---|---|---|
| 5,312,692 | A * | 5/1994 | Shiraishi | 428/32.87 |
| 5,529,891 | A | 6/1996 | Wang et al. | |
| 6,316,172 | B1 * | 11/2001 | Hashimoto | 430/350 |
| 6,635,601 | B2 * | 10/2003 | Lelental et al. | 503/201 |
| 2002/0068246 | A1 * | 6/2002 | Morita | 430/523 |
| 2005/0282095 | A1 * | 12/2005 | Morita et al. | 430/619 |

FOREIGN PATENT DOCUMENTS

| | | | |
|---|---|---|---|
| EP | 1045284 | | 10/2000 |
| JP | 62138851 | | 6/1987 |
| JP | 200398630 | | 4/2003 |
| JP | 2006-003702 | * | 1/2006 |
| JP | 2006126247 | | 5/2006 |

* cited by examiner

*Primary Examiner*—Thorl Chea
(74) *Attorney, Agent, or Firm*—Lucas & Mercanti, LLP

(57) ABSTRACT

A silver salt photothermographic dry imaging material comprising a support having: (i) a photosensitive layer comprising photosensitive silver halide grains, an organic silver salt and a reducing agent for silver ions on one side of the support; and (ii) a backing layer on a side of the support opposite the photosensitive layer, comprising: (a) organic solid lubricant particles having an average diameter of 1.0 to 30 μm; and (b) inorganic microparticles or organic microparticles.

16 Claims, No Drawings

SILVER SALT PHOTOTHERMOGRAPHIC DRY IMAGING MATERIAL

TECHNICAL FIELD

The present invention relates to a silver salt photothermographic dry imaging material, the conveying properties of which are markedly improved.

BACKGROUND

Heretofore, in graphic arts and medical fields, effluent generated by wet processing of image forming materials has resulted in problems in view of workability. In recent years, in view of environmental protection and space saving, highly demanded has been a decrease in processing effluent. Consequently, demanded have been technologies in regard to photothermographic materials for photographic use, which enable efficient exposure employing laser image setters and laser imagers, and enable forming clear black images at high resolution. Known as such technology are silver salt photothermographic dry imaging materials which incorporate a support having thereon organic silver salts, photosensitive silver halide grains, reducing agents, and binders (refer, for example, to Patent Documents 1 and 2, and Non-Patent Document 1).

These silver salt photothermographic dry imaging materials form photographic images via heat development, and incorporate reducible silver sources (such as organic silver salts), photosensitive silver halide, reducing agents, and if desired, toners which control silver tone, all of which are in a dispersed state, commonly in an (organic) binder matrix. The above silver salt photothermographic dry imaging materials are stable at normal temperature. However, when heated to relatively high temperatures (for example, 80-140° C.) after exposure, they are developed into visible images. Via heating, silver is formed through the oxidation-reduction reaction between the organic silver salts (which function as an oxidizing agent) and the reducing agents. This oxidation-reduction reaction is promoted by catalytic action of latent images formed on silver halide by exposure. Silver, which is formed via the reaction of organic silver salts in the exposed area provides a black image with respect to the unexposed areas, whereby an image is formed. The above reaction process proceeds without any supply of a processing liquid such as water from the exterior.

Such silver salt photothemographic dry imaging materials are commonly prepared in such a manner that layers such as emulsion layers, if desired, interlayers, a protective layer, a backing layer, an antihalation layer, or an antistatic layer, which constitute the above silver salt photothermographic dry imaging materials, are variously combined and applied onto a support such as a plastic film. The silver salt photothermographic dry imaging materials are frequently adversely affected by contact with various apparatuses and contact between the front and back sides during winding, unwinding, and conveyance in each production process such as coating, drying and packaging. Examples include the formation of scratches and sliding abrasion on the surface of silver salt photothermographic dry imaging materials, as well as degradation of conveying properties of silver salt photothermographic dry imaging materials in a processing apparatus.

On the other hand, it is required that silver salt photothermographic dry imaging materials are provided with specific characteristics for heat development. For example, since humidity in the interior of a thermal processor employed for heat development becomes excessively low due to the increase in temperature to tend to generate static electricity, whereby problems occur in which it is not possible to separately convey each of the silver salt photothermographic dry imaging materials and conveying problems such as jamming tend to result.

In order to overcome the above drawbacks, disclosed are a method in which improvement is achieved employing alkylsilane compounds having at least 8 carbon atoms (refer, for example, to Patent Document 3), and a method employing sulfur based or ester based lubricants (refer, for example, to Patent Document 4). However, both methods result in problems in which photographic performance is adversely affected, that is, specifically, image tone is degraded. Further, problems surface in which the interior of a thermal processor at high temperature is stained and it is not possible to sufficiently provide lubrication properties at high temperatures.

To overcome the above drawback, disclosed is a method employing inorganic solid lubricants (refer, for example, to Patent Document 5). Recently, however, the conveying rate in thermal processors and the processing rate in automatic processors have been markedly increased, and it is difficult to state that the above proposed method has overcome the drawback. Consequently, it has been further demanded to improve lubrication properties.

Further, to overcome these drawbacks, provided are heat developable photosensitive materials in which crystalline metal oxides, which exhibit less humidity dependence of electrical conductivity, are employed (refer, for example, to Patent Documents 6-9). In these heat developable photosensitive materials, employed are ionic surface active agents and hygroscopic polysilicic acid in the outermost layer, whereby these components are easily affected by humidity to occasionally result in variation of surface resistivity. Further, a more critical drawback has been noted in which during storage in such a state that heat developable photosensitive materials are brought into contact with each other, these surface active agents are transferred to the surface opposite the incorporation layer due to relatively small molecules, whereby photographic performance and lubrication properties are adversely affected.

(Patent Document 1) U.S. Pat. No. 3,152,904

(Patent Document 2) U.S. Pat. No. 3,487,075

(Patent Document 3) U.S. Pat. No. 36,020,117

(Patent Document 4) Japanese Patent Publication Open to Public Inspection (hereinafter referred to as JP-A) No. 2001-005137

(Patent Document 5) JP-A No. 2002-116520

(Patent Document 6) JP-A No. 7-49543 (Examples)

(Patent Document 7) JP-A No. 8-43988 (Examples)

(Patent Document 8) JP-A No. 11-24200 (Examples)

(Patent Document 9) JP-A No. 2000-162731 (Claim 1 and Examples)

(Non-patent Document 1) D. Morgan, "Dry Silver Photographic Materials" Handbook of Imaging Materials, Marcel Dekker, Inc., page 48, 1991

SUMMARY

In view of the foregoing, the present invention was achieved. An object of the present invention is to provide a silver salt photothermographic dry imaging material which exhibits excellent conveying properties during heat development.

The above object of the present invention is enabled employing the following embodiments.

1. In a silver salt photothermographic dry imaging material which incorporates a support having, on one surface, a photosensitive layer containing photosensitive silver halide, organic silver salts, and reducing agents, and on the opposite surface across the above support, a backing layer, a silver salt photothermographic dry imaging material wherein the aforesaid backing layer incorporates organic solid lubricant particles and minute inorganic particles (or called as inorganic microparticles) of an average particle diameter of 1.0-30 μm.

2. In a silver salt photothermographic dry imaging material which incorporates a support having, on one surface, a photosensitive layer containing photosensitive silver halide, organic silver salts, and reducing agents, and on the opposite surface across the above support, a backing layer, a silver salt photothermographic dry imaging material wherein the aforesaid backing layer incorporates organic solid lubricant particles and minute organic particles (or called as organic microparticles) of an average particle diameter of 1.0-30 μm.
3. The silver salt photothermographic dry imaging material described in above Item 1 or 2 wherein the melting point of the aforesaid organic solid lubricant particles is 80-350° C.
4. The silver salt photothermographic dry imaging material described in any one of above Items 1-3 wherein the aforesaid organic solid lubricant particles are the compound represented by following Formula (1).

$$(R_1—X_1)_p\text{-L-}(X_2—R_2)_q \qquad \text{Formula (1)}$$

wherein $R_1$ and $R_2$ each represents a substituted or unsubstituted alkyl group, alkenyl group, aralkyl group, or aryl group each having 6-60 carbon atoms; p and q each represents an integer of 0 to 6, when p or q is at least 2, a plurality of $R_1$ and $R_2$ may be the same or different; $X_1$ and $X_2$ each represents a divalent linking group containing a nitrogen atom, and L represents a substituted or unsubstituted p+q valent alkyl group, alkenyl group, aralkyl group, or aryl group.

5. The silver salt photothermographic dry imaging material described in any one of above Items 1-3 wherein the aforesaid organic solid lubricant particles are minute particles composed of one polymer compound selected from polyethylene, polypropylene and polytetrafluoroethylene.
6. The silver salt photothermographic dry imaging material described in any one of above Items 1-3 wherein the aforesaid organic solid lubricant particles are composed of metal soap.
7. The silver salt photothermographic dry imaging material described in any one of above Items 1-3 wherein the aforesaid organic solid lubricant particles are composed of the compound represented by following Formula (2).

$$(R_1)—COO\text{-}M\text{-}OOC—(R_2) \qquad \text{Formula (2)}$$

wherein $R_1$ and $R_2$ each represents a substituted or unsubstituted alkyl group, alkenyl group, aralkyl group, or aryl group having 6-60 carbon atoms, and M represents divalent metal. $R_1$ and $R_2$ may be the same or different.

8. The silver salt photothermographic dry imaging material described in any one of above Items 1-7 wherein the weight ratio of the aforesaid organic solid lubricant particles to the aforesaid minute inorganic particles, or of the aforesaid minute organic particles in the aforesaid backing layer, is 1:99-99:1.
9. The silver salt photothermographic dry imaging material described in any one of above Items 1-7 wherein the weight ratio of the aforesaid organic solid lubricant particles to the aforesaid minute inorganic particles, or of the aforesaid minute organic particles in the aforesaid backing layer, is 5:95-95:5.
10. The silver salt photothermographic dry imaging material described in any one of above Items 1-7 wherein the weight ratio of the aforesaid organic solid lubricant particles to the aforesaid minute inorganic particles, or of the aforesaid minute organic particles in the aforesaid backing layer is 50:50-95:5.
11. The silver salt photothermographic dry imaging material described in any one of above Items 1, and 3-10 wherein the aforesaid minute inorganic particles are minute porous particles.
12. The silver salt photothermographic dry imaging material described in any one of above Items 1, and 3-11 wherein the aforesaid minute inorganic particles are metal oxides.
13. The silver salt photothermographic dry imaging material described in any one of above Items 1, and 3-12 wherein the aforesaid minute inorganic particles are silica.
14. The silver salt photothermographic dry imaging material described in any one of above Items 2-10 wherein the aforesaid minute organic particles are minute polymer particles.
15. The silver salt photothermographic dry imaging material described in any one of above Items 2-10 and 14 wherein the aforesaid minute organic particles are composed of at least one selected from an acrylic resin, a styrene resin, a melamine resin, or a polyurethane resin.
16. The silver salt photothermographic dry imaging material described in any one of above Items 2-10, 14, and 15 wherein the aforesaid minute organic particles are composed of polymethyl methacrylate or three-dimensionally crosslinked polymethyl methacrylate.
17. The silver salt photothermographic dry imaging material described in any one of above Items 1-16 wherein the aforesaid backing layer incorporates polyester resins.
18. The silver salt photothermographic dry imaging material described in any one of above Items 1-17 wherein heat development is performed at a conveying rate of at least 30 mm/second.

Based on the present invention, it is possible to provide a silver salt photothermographic dry imaging material which exhibits excellent conveying properties during heat development.

DESCRIPTION OF THE PREFERRED EMBODIMENTS

Preferred embodiments to practice the present invention will now be detailed.

In view of the foregoing, the inventors of the present invention conducted diligent investigations and discovered the following, and thereby achieved the present invention. In a silver salt photothermographic dry imaging material which incorporated a support having, on one surface, a photosensitive layer containing photosensitive silver halide, organic silver salts, and reducing agents, and on the opposite surface across the above support a backing layer, it was discovered that conveying properties during heat development were markedly improved by employing a silver salt photothermographic dry imaging material which was characterized in that the aforesaid backing layer incorporated organic solid lubricant particles and minute inorganic, or organic particles, of an average particle diameter of 1.0-30 μm.

The present invention will now be detailed.

In the silver salt photothermographic dry imaging martial (hereinafter also referred to as heat developable photosensitive material, photosensitive material, or imaging material) of the present invention, one of the features is that a backing layer is provided on the opposite surface of the photosensitive layer across the support, and the aforesaid backing layer incorporates organic solid lubricant particles of an average particle diameter of 1.0-30 μm. The melting point of the organic solid lubricant particles is preferably 110-200° C., and the average diameter of the organic solid lubricant particles is 2.0-20 μm, but is more preferably 3.0-10 μm. The above melting point is more preferably 110-180° C. The solubility in solvents is preferably at most 5% by weight (0.5%-0% by weight).

By incorporating the organic solid lubricants according to the present invention in the backing layer, surface energy of the surface of photosensitive materials is decreased to retard fusion of the heating medium with the photosensitive side of photosensitive materials during development, and decreases the friction coefficient, whereby it is possible to markedly improve conveying properties. Further, by incorporating minute inorganic or organic particles, adhesion between supports is decreased to enable easy pick-up of each sheet, whereby conveying properties are improved.

It was found that organic solid lubricant particles according to the present invention exhibited excellent performance compared to boron nitride which was conventionally employed as an inorganic solid lubricant.

Preferred as the organic solid lubricant particles according to the present invention are compounds which lower the surface energy of photosensitive materials. Preferred examples include minute particles of at least one polymer compound selected from polyethylene, polypropylene, and polytetrafluoroethylene.

Examples of organic solid lubricant particles composed of polyethylene and polypropylene are listed below, but they are not limited thereto.

PW-1: polyethylene (at a low degree of polymerization, a melting point of 113° C., and an average particle diameter of 3.6 μm)

PW-2: polypropylene/polyethylene (at a melting point of 142° C., and an average particle diameter of 9.6 μm)

PW-3: low density polyethylene (at a melting point of 113° C., and an average particle diameter of 7.6 μm)

PW-4: high density polyethylene (at a melting point of 126° C., and an average particle diameter of 10.3 μm)

PW-5: polypropylene (at a melting point of 145° C., and an average particle diameter of 8.8 μm)

Further, preferred as organic solid lubricant particles are those composed of the compounds represented by above Formula (1).

The number of total carbon atoms of the compounds represented by above Formula (1), according to the present invention, is not particularly limited. The above number is commonly preferably at least 20, but is more preferably at least 30. Cited as examples of substituents, which may be incorporated in the alkyl group, the alkenyl group, the aralkyl group or the aryl group, which is as defined in $R_1$ and $R_2$, may be a halogen atom, a hydroxyl group, a cyano group, an alkoxy group, an aryloxy group, an alkylthio group, an arylthio group, an alkoxycarbonyl group, an aryloxycarbonyl group, an amino group, an acylamino group, a sulfonylamino group, a ureido group, a carbamoyl group, a sulfamoyl group, an acyl group, a sulfonyl-group, an aryl group and an alkyl group. These groups may further have a substituent(s). Preferred substituents include a halogen atom, a hydroxyl group, an alkoxy group, an alkylthio group, an alkoxycarbonyl group, an acylamino group, a sulfonylamino group, an acyl group and an alkyl group. Preferred halogen atoms include fluorene and chlorine atoms.

Alkyl components of the alkoxy group, the alkylthio group, and the alkoxycarbonyl group are the same as the alkyl group represented by following $R_2$. The amino group of the acylamino group and the sulfonylamino group may be an N-substituted amino group, but the substituent is preferably an alkyl group. The group which is bonded to the carbonyl group of the acylamino group or the acyl group, as well as the group, which is bonded to the sulfonyl group of the sulfonylamino group, is an alkyl group or an aryl group, but the above alkyl groups are preferred.

Each of $R_1$ and $R_2$ is a substituted or unsubstituted alkyl group, alkenyl group, aralkyl group, or aryl group which commonly has 6-60 carbon atoms, has preferably 6-40 carbon atoms, but has more preferably 10-30 carbon atoms. Any of these alkyl, alkenyl, and aralkyl groups may be in the form of a straight or branched chain, or a ring structure, or combinations of these. Cited as examples of preferred $R_1$ and $R_2$ may be an octyl group, a t-octyl group, a dodecyl group, a tetradecyl group, a hexadecyl group, a 2-hexyldecyl group, an octadecyl group, $C_nH_{2n+1}$ (wherein n represents 20-60), an eicosyl group, a docosanyl group, an melissinyl group, an octenyl group, a myristoryl group, an oleyl group, an erucyl group, a phenyl group, a naphthyl group, a benzyl group, a nonylphenyl group, a dipentylphenyl group, and a cyclohexyl group, as well as a group having any of the above substituents.

Each of $X_1$ and $X_2$ represents a divalent linking group incorporating a nitrogen atom, but is preferably —$CONR_3$—, —$NR_4CONR_5$—, or —$NR_6COO$—.

L represents a substituted or unsubstituted p+q valent-alkyl, alkenyl, aralkyl, or aryl group. The number of carbon atoms of the hydrocarbon group is not particularly limited, while it is preferably 1-60, is more preferably 1-40, but is most preferably 10-40. The term, "p+q valence" of the p+q valent hydrocarbon group means that p+q hydrogen atoms in a hydrocarbon are removed and the number of p of $X_1$—group(s) and the number of q of —$X_2$ group(s) are bonded thereto. Each of p and q represents an integer of 0-6 and hold commonly the relationship of $1 \leqq p+q \leqq 6$, but hold preferably the relationship of $1 \leqq p+q \leqq 4$, in which cases are preferred in which both p and q represent 1.

The compounds represented by above Formula (1) may be either synthesized or natural products. Synthesized products prepared employing raw materials such as natural higher fatty acids or alcohols include mixtures exhibiting different number of carbons atoms, straight or branched chains. It is possible to employ such mixtures without any problem. However, in view of quality stability of compositions, synthesized products are preferred.

The specific examples represented by Formula (1) will now be listed, however, the present invention is not limited thereto.

OW-1: lauric acid amide (at a melting point of 87° C. and an average particle diameter of 4.5 μm)

OW-2: palmitic acid amide (at a melting point of 100° C. and an average particle diameter of 5.6 μm)

OW-3: stearic acid amide (at a melting point of 101° C. and an average particle diameter of 5.5 μm)

OW-4: behenic acid amide (at a melting point of 98° C. and an average particle diameter of 6.7 μm)

OW-5: hydroxystearic acid amide (at a melting point of 107° C. and an average particle diameter of 6.7 μm)

OW-6: oleic acid amide (at a melting point of 75° C. and an average particle diameter of 3.4 μm)

OW-7: erucic acid amide (at a melting point of 81° C. and an average particle diameter of 4.3 μm)

OW-8: ricinoleic acid amide (at a melting point of 62° C. and an average particle diameter of 5.2 μm)

OW-9: N-lauryllauric acid amide (at a melting point of 77° C. and an average particle diameter of 4.4 μm)

OW-10: N-palmitylpalmitic acid amide (at a melting point of 91° C. and an average particle diameter of 4.5 μm)
OW-11: N-stearylstearic acid amide (at a melting point of 95° C. and an average particle diameter of 5.5 μm)
OW-12: N-oleyloleic acid amide (at a melting point of 35° C. and an average particle diameter of 5.3 μm)
OW-13: N-searyloleic acid amide (at a melting point of 67° C. and an average particles diameter of 5.4 μm)
OW-14: N-oleylstearic acid amide (at a melting point of 74° C. and an average particle diameter of 4.5 μm)
OW-15: N-searylerucic acid amide (at a melting point of 69° C. and an average particles diameter of 4.7 μm)
OW-16: N-oleylpalmitic acid amide (at a melting point of 68° C. and an average particle diameter of 5.0 μm)
OW-17: N-searyl-1,2-hydroxystearic acid amide (at a melting point of 102° C. and an average particle diameter of 7.3 μm)
OW-18: N-oleyl-1,2-hydroxystearic acid amide (at a melting point of 90° C. and an average particle diameter of 7.8 μm)
OW-19: methylolstearic acid amide (at a melting point of 110° C. and an average particle diameter of 6.7 μm)
OW-20: methylolbehenic acid amide (at a melting point of 110° C. and an average particle diameter of 5.6 μm)
OW-21: methylenebisstearic acid amide (at a melting point of 142° C. and an average particles diameter of 6.7 μm)
OW-22: methylenebislauric acid amide (at a melting point of 131° C. and an average particle diameter of 5.7 μm)
OW-23: methylenebishydroxystearic acid amide (at a melting point of 143° C. and an average particle diameter of 5.5 μm)
OW-24: ethylenebiscaprylic acid amide (at a melting point of 165° C. and an average particle diameter of 5.8 μm)
OW-25: ethylenebiscapric acid amide (at a melting point of 161° C. and an average particles diameter of 6.7 μm)
OW-26: ethylenebislauric acid amide (at a melting point of 157° C. and an average particle diameter of 6.5 μm)
OW-27: ethylenebisstearic acid amide (at a melting point of 145° C. and an average particle diameter of 7.8 μm)
OW-28: ethylenebisisostearic acid amide (at a melting point of 106° C. and an average particle diameter of 4.6 μm)
OW-29: ethylenebishydroxystearic acid amide (at a melting point of 145° C. and an average particle diameter of 6.9 μm)
OW-30: ethylenebisbehenic acid amide (at a melting point of 142° C. and an average particle diameter of 6.6 μm)
OW-31: hexamethylenebisstearic acid amide (at a melting point of 140° C. and an average particles diameter of 7.6 μm)
OW-32: hexamethylenebisbehenic acid amide (at a melting point of 142° C. and an average particle diameter of 6.7 μm)
OW-33: hexamethylenebishydroxystearic acid amide (at a melting point of 135° C. and an average particles diameter of 8.1 μm)
OW-34: butylenebishydroxystearic acid amide (at a melting point of 140° C. and an average particle diameter of 7.8 μm)
OW-35: N,N'-distearyladipic acid amide (at a melting point of 141° C. and an average particle diameter of 8.5 μm)
OW-36: N,N'-distearylsebacic acid amide (at a melting point of 136° C. and an average particle diameter of 7.8 μm)
OW-37: methylenebisoleic acid amide (at a melting point of 116° C. and an average particle diameter of 6.7 μm)
OW-38: ethylenebisoleic acid amide (at a melting point of 119° C. and an average particle diameter of 6.7 μm)
OW-39: ethylenebiserucic acid amide (at a melting point of 120° C. and an average particle diameter of 7.8 μm)
OW-40: hexamethylenebisoleic acid amide (at a melting point of 110° C. and an average particle diameter of 7.5 μm)
OW-41: N,N'-dioleyladipic acid amide (at a melting point of 118° C. and an average particle diameter of 5.6 μm)
OW-42: N,N'-dioleylcebacic acid amide (at a melting point of 113° C. and an average particle diameter of 6.7 μm)
OW-43: m-xylylenestearic acid amide (at a melting point of 123° C. and an average particle diameter of 7.8 μm)
OW-44: N,N'-distearylisophthalic acid amide (at a melting point of 125° C. and an average particle diameter of 8.7 μm)
OW-45: ethanolamine distearate (at a melting point of 82° C. and an average particle diameter of 4.3 μm)
OW-46: N-butyl-N'-stearylurea (at a melting point of 94° C. and an average particle diameter of 4.6 μm)
OW-47: N-phenyl-N'-stearylurea (at a melting point of 99° C. and an average particle diameter of 5.6 μm)
OW-48: N-stearyl-N'-stearylurea (at a melting point of 109° C. and an average particle diameter of 6.7 μm)
OW-49: xylylenebisstearylurea (at a melting point of 166° C. and an average particle diameter of 6.0 μm)
OW-50: tolylenebisstearylurea (at a melting point of 172° C. and an average particle diameter of 7.8 μm)
OW-51: hexamethylenebisstearylurea (at a melting point of 173° C. and an average particle diameter of 6.5 μm)
OW-52: diphenylmethanebisstearylurea (at a melting point of 206° C. and an average particle diameter of 7.6 μm)
OW-53: ethylenebisstearic acid amide (at a melting point of 145° C. and an average particle diameter of 3.5 μm)

Further, preferred as the organic solid lubricant particles are those composed of the compounds represented by above Formula (2). In the organic solid lubricant particles represented by Formula (2) according to the present invention, the number of the total carbon atoms is not particularly limited, and is commonly preferably 10-24, but is more preferably 12-20. Cited as substituents capable of being incorporated in the alkyl group, the alkenyl group, the aralkyl group or the aryl group, as defined for $R_1$ and $R_2$, may for example, be a halogen atom, a hydroxyl group, a cyano group, an alkoxy group, an aryloxy group, an alkylthio group, an arylthio group, an alkoxycarbonyl group, an aryloxycarbonyl group, an amino group, an acylamino group, a sulfonylamino group, a ureido group, a carbamoyl group, a sulfamoyl group, an acyl group, a sulfonyl group, a sulfinyl group, an aryl group, and an alkyl group. These groups may a have substituent(s). Preferred substituents include a halogen atom, a hydroxyl group, an alkoxy group, an alkylthio group, an alkoxycarbonyl group, an acylamino group, a sulfonylamino group, an acyl group, and an alkyl group. Preferred as a halogen atom are a fluorine atom and a chlorine atom.

Alkyl components of the alkoxy group, the alkylthio group, and the alkoxycarbonyl group are the same as the alkyl group represented by following $R_2$. The amino group of the acylamino group and the sulfonylamino group may be an N-substituted amino group, and the substituent is preferably an alkyl group. The group which is bonded to the carbonyl group of the acylamino group or the acyl group, as well as the group which is bonded to the sulfonyl group of the sulfonylamino group, is an alkyl group or an aryl group, but the above alkyl groups are preferred.

Each of $R_1$ and $R_2$ may be in the form of a straight or branched chain, or a ring structure, or these may be in combinations of them. Cited as examples of preferred $R_1$ and $R_2$ may be an octyl group, a t-octyl group, a dodecyl group, a tetradecyl group, a hexadecyl group, a 2-hexyldecyl group, an octadecyl group, $C_nH_{2n+1}$ (where n represents 20-60), an eicosyl group, a docosanyl group, a melissinyl group, an octenyl group, a myristoryl group, an oleyl group, an erucyl group, a phenyl group, a naphthyl group, a benzyl group, a nonylphenyl group, a dipentylphenyl group, and a cyclohexyl group, as well as any group having any of the above substituents.

Metal soaps represented by Formula (2), which are composed of organic solid lubricant particles in the present invention, are composed of saturated or unsaturated fatty acid having at least 4 carbon atoms represented by simple fatty acids such as caprylic acid, capric acid, lauric acid, myristic acid, myristoleinic acid, palmitic acid, isopalmitic acid, palmitoleinic acid, stearic acid, behenic acid, lignoceric acid, cerotic acid, montanic acid, isostearic acid, oleic acid, arachic acid, recinoleic acid, linoleic acid, behenic acid, or erucic acid, as well as beef tallow fatty acid, soybean oil fatty acid, and coconut oil fatty acid, in addition to alkali earth metals such as calcium, barium, or magnesium, and divalent metals such as titanium, zinc, copper, manganese, cadmium, mercury, zirconium, lead or iron. Of these, particularly preferred are calcium salts, zinc salts, or barium salts of saturated or unsaturated fatty acids having 10-24 carbon atoms, but preferably having 12-22 carbon atoms. They may be employed individually or in combinations of at least two types.

Examples of metal soaps which are organic solid lubricant particles are listed below, however the present invention is not limited thereto.

1-1: calcium palimitate
1-2: barium palimitate
1-3: zinc palimitate
1-4: magnesium stearate
1-5: barium stearate
1-6: calcium stearate
1-7: zinc stearate
1-8: magnesium 12-hydroxy stearate
1-9: barium 12-hydroxy stearate
1-10: calcium 12-hydroxy stearate
1-11: zinc 12-hydroxy stearate
1-12: calcium behenate
1-13 zinc behenate
1-14: magnesium behenate
1-15: copper behenate
1-16: magnesium laurate
1-17: zinc laurate
1-18: barium laurate
1-19: calcium laurate
1-20: calcium montanate
1-21: barium montanate
1-22: zinc montanate
1-23: magnesium montanate
1-24: nickel oleate
1-25: zinc myristate
1-26: calcium myristate
1-27: magnesium myristate
1-28: zinc beef tallow fatty acid
1-29: calcium beef tallow fatty acid
1-30: magnesium beef tallow fatty acid The average particle diameter described in the present invention is determined as follows. The compound according to the present invention, which has been dispersed, is diluted, and dispersed on a grid with a carbon support film. Subsequently, the particle image is captured at a direct magnification by a factor of 5,000, employing a transmission type electron microscope (for example, 2000 FX TYPE, produced by JEOL Ltd.). Thereafter, the resulting negative image is inputted as a digital image, employing a scanner, and the particle diameter (being the equivalent circular diameter) of each of at least 300 particles is determined employing appropriate image processing software. Subsequently, the arithmetic means is obtained, resulting in the quoted average particle diameter.

Minute inorganic particles which are employed together with the above-mentioned organic solid lubricant particles in the backing layer according to the present invention will now be described.

Minute inorganic particles, which are applicable to the present invention, are described in Bunsan Gijutsu Kenkyukai Kikaku, "Suspension (Ko/Eki Bunsan Kei) o chuushin to shita Bunsan Gijutsu to Kogyo teki Oyo no Jissai (Practices of Dispersion Techniques and Industrial Applications Majored in Suspension (Solid/Liquid Dispersion System)) (1978)" and "Cho-Biryushi Handbook (Ultra-minute Particles Handbook) (1990)", compiled under the supervision of Shinroku Saito. Listed as components are halloysite, calcium carbonate, magnesium carbonate, silica anhydride and hydride, mica, alumina, aluminum hydroxide, aluminum borate, titanium dioxide, potassium titanate, tin oxide, zinc oxide, antimony oxide, carbon black, and ceramic. Commercially available products include SEAHOSTER KE-E150 and SEAHOSTER-KE-P-250 (both employing silica as a main component) (produced by Nippon Shokubai Co., Ltd.); SANSFAIR H-31, SANSFAIR H-51, and SANSFAIR H-201 (all produced by Dokai Kagaku); SYLYSIA 250, SYLYSIA 320, SYLYSIA 380, SYLYSIA 450, and SYLYSIA 470 (all produced by Fuji Silysia Chemical Ltd.), TALC SG-100 and TALC SG-200 (both produced by Nippon Talc Co., Ltd.); and TOSPEARL 145 and TOSPEARL 2000B (both produced by GE Toshiba Silicone).

In the present invention, of the above minute inorganic particles, preferred are those having a porous structure, but more preferred are minute silica particles.

Further, the weight ratio of the above organic solid lubricant particles to the above minute inorganic particles is preferably 1:99-99:1, is more preferably 5:99-99:5, but is most preferably 50:50-95:50.

The average diameter of the aforesaid minute inorganic particles is preferably 1.0-20 μm, is more preferably 2.0-15 μm, but is most preferably 2.5-12 μm.

Minute organic particles which are employed, in the backing layer according to the present invention, together with the organic solid lubricant particles described above, will now be described.

Employed as minute organic particles applicable to the present invention may be any of the minute organic particles known in the art, of which the minute polymer particles are preferred. The weight average molecular weight of the above minute polymer particles is preferably 3,000-200,000, but is more preferably 5,000-100,000. Preferably employed as such minute polymer particles are those composed of acrylic resins, styrene resins, melamine resins, and polyurethane resins. Examples include polymethyl methacrylate, polyethyl methacrylate, polymethyl acrylate, polymethyl acrylate, poly-n-butyl methacrylate, polyisobutyl methacrylate, polystyrene, styrene-divinylbenzene copolymers, 3-methyl methacrylate-divinylbenzene copolymers, 3-dimensionally crosslinked polymethyl methacrylate, 3-dimensionally crosslinked polystyrene, 3-dimensionally crosslinked melamine reins, and 3-dimensionally crosslinked polyurethane resins. Of these, most preferably employed is polymethyl methacrylate or 3-dimensionally crosslinked polymethyl methacrylate.

Further, the weight ratio of the above organic solid lubricant particles to the above minute organic particles in the backing layer according to the present invention is preferably 1:99-99:1, is more preferably 5:95-99:5, but is most preferably 50:50-95:5.

The average diameter of the aforesaid minute organic particles is preferably 1.0-20 μm, is more preferably 2.0-15 μm, but is most preferably 2.5-12 μm.

Polyester resins which are preferably employed in the backing layer according to the present invention will now be described.

In the silver salt photothermographic dry imaging materials of the present invention, it is preferable that polyester resins are employed as a binder in the backing layer since it is thereby possible to improve the adhesion properties of the backing layer to the support of the silver salt photothermographic dry imaging materials of the present invention.

Employed as polyester resins applicable to the present invention may be those which are commercially available. Specific examples are cited below, however the present invention is not limited thereto.

H-1: VITTEL PE2200B (produced by Bostic Co.)
H-2: VITTEL PE2700B (produced by Bostic Co.)
H-1: VITTEL PE3200B (produced by Bostic Co.)
H-1: VITTEL PE3300B (produced by Bostic Co.)
H-1: VITTEL PE3550B (produced by Bostic Co.)
H-6: VYLON 103 (produced by TOYOBO, Ltd.)
H-7: VYLON 200 (produced by TOYOBO, Ltd.)
H-8: VYLON 240 (produced by TOYOBO, Ltd.)
H-9: VYLON 650 (produced by TOYOBO, Ltd.)

The added amount of the polyester resins is preferably in the range of 50-1,000 mg per $m^2$ of the backing layer of the heat developable photosensitive material. It is possible to conduct the addition in such a manner that they are dissolved in solvents and added to the backing layer liquid coating composition, wherein methyl ethyl ketone is employed as the solvent.

In view of further exhibiting the object of the present invention, it is preferable that in the silver salt photothermographic dry imaging material, the backing layer according to the present invention further incorporates the fluorine-containing compounds represented by following Formula (2a).

$$M_1O_3S—(CF_2)_m—SO_3M_1 \qquad \text{Formula (2a)}$$

In above Formula (2a), $M_1$ represents H, Li, Na, K, or an ammonium group, while m represents an integer of 1-8. However, when $M_1$ represents Li, m represents an integer of 1-4; when $M_1$ represents H, m represents an integer of 1-6 or 8; when $M_1$ represents Na, m represents an integer of 4; when $M_1$ represents K, m represents an integer of 1-6; and when $M_1$ represents an ammonium group, m represents an integer of 1-8.

When $M_1$ represents an ammonium group, other than $NH_4$, included are prior art primary through quaternary organic ammonium groups (such as methylammonium, dibutylammonium, triethylammonium, or tetradecylammonium) in which 1-4 hydrogen atoms are substituted with any of the various alkyl groups.

Specific examples of the compounds represented by Formula (2a) will now be listed below, however the present is not limited thereto.

| | |
|---|---|
| 2-1 | $LiO_3S(CF_2)SO_3Li$ |
| 2-2 | $LiO_3S(CF_2)_2SO_3Li$ |
| 2-3 | $LiO_3S(CF_2)_3SO_3Li$ |
| 2-4 | $LiO_3S(CF_2)_4SO_3Li$ |
| 2-5 | $HO_3S(CF_2)SO_3H$ |
| 2-6 | $HO_3S(CF_2)_2SO_3H$ |
| 2-7 | $HO_3S(CF_2)_3SO_3H$ |
| 2-8 | $HO_3S(CF_2)_4SO_3H$ |
| 2-9 | $HO_3S(CF_2)_5SO_3H$ |
| 2-10 | $HO_3S(CF_2)_6SO_3H$ |
| 2-11 | $HO_3S(CF_2)_8SO_3H$ |
| 2-12 | $NaO_3S(CF_2)_4SO_3Na$ |
| 2-13 | $KO_3S(CF_2)SO_3K$ |
| 2-14 | $KO_3S(CF_2)_3SO_3K$ |
| 2-15 | $KO_3S(CF_2)_6SO_3K$ |
| 2-16 | $H_4NO_3S(CF_2)SO_3NH_4$ |
| 2-17 | $H_4NO_3S(CF_2)_2SO_3NH_4$ |
| 2-18 | $H_4NO_3S(CF_2)_4SO_3NH_4$ |
| 2-19 | $H_4NO_3S(CF_2)_6SO_3NH_4$ |
| 2-20 | $H_4NO_3S(CF_2)_8SO_3NH_4$ |
| 2-21 | $(C_2H_5)_3HNO_3S(CF_2)SO_3NH(C_2H_5)_3$ |
| 2-22 | $(C_2H_5)_3HNO_3S(CF_2)_3SO_3NH(C_2H_5)_3$ |
| 2-23 | $(C_2H_5)_3HNO_3S(CF_2)_6SO_3NH(C_2H_5)_3$ |
| 2-24 | $HO_3S(CF_2)_3SO_3H_3N\text{-}(CH_2CH_2O)_{20}CH_2CH_2NH_3O_3S\text{-}(CF_2)_3\text{-}SO_3H$ |
| 2-25 | $(C_4H_9)_4NO_3S(CF_2)_3SO_3N(C_4H_9)_4$ |
| 2-26 | $Ba[O_3S(CF_2)SO_3]$ |
| 2-27 | $Ba[O_3S(CF_2)_3SO_3]$ |
| 2-28 | $Ba[O_3S(CF_2)_5SO_3]$ |
| 2-29 | $Ca[O_3S(CF_2)SO_3]$ |
| 2-30 | $Ca[O_3S(CF_2)_2SO_3]$ |
| 2-31 | $Ca[O_3S(CF_2)_4SO_3]$ |
| 2-32 | $Ca[O_3S(CF_2)_6SO_3]$ |
| 2-33 | $Ca[O_3S(CF_2)_8SO_3]$ |
| 2-34 | $Mg[O_3S(CF_2)SO_3]$ |
| 2-35 | $Mg[O_3S(CF_2)_3SO_3]$ |
| 2-36 | $Mg[O_3S(CF_2)_5SO_3]$ |
| 2-37 | $Mg[O_3S(CF_2)_7SO_3]$ |
| 2-38 | $Mg[O_3S(CF_2)_8SO_3]$ |
| 2-39 | $HO_3SCF_2CF_2OCF_2CF_2SO_3H$ |
| 2-40 | $LiO_3SCF_2CF_2OCF_2CF_2SO_3Li$ |

-continued

| | |
|---|---|
| 2-41 | $NaO_3SCF_2CF_2OCF_2CF_2SO_3Na$ |
| 2-42 | $KO_3SCF_2CF_2OCF_2CF_2SO_3K$ |
| 2-43 | $H_4NO_3SCF_2CF_2OCF_2CF_2SO_3NH_4$ |
| 2-44 | $CH_3H_3NO_3SCF_2CF_2OCF_2CF_2SO_3NH_3CH_3$ |
| 2-45 | $(C_4H_9)_2H_2NO_3SCF_2CF_2OCF_2CF_2SO_3NH_2(C_4H_9)_2$ |
| 2-46 | $(C_2H_6)_3HNO_3SCF_2CF_2OCF_2CF_2SO_3NH(C_2H_5)_3$ |
| 2-47 | $(C_{12}H_{25})_4NO_3SCF_2CF_2OCF_2CF_2SO_3N(C_{12}H_{25})_4$ |
| 2-48 | $H_2N(CH_2CH_2O)_{20}—CH_2CH_2NH_3O_3S—CF_2CF_2OCF_2CF_2SO_3NH_3(CH_2CH_2O)_{20}CH_2CH_2NH_2$ |
| 2-49 | $Ca[O_3SCF_2CF_2OCF_2CF_2SO_3]$ |
| 2-50 | $Mg[O_3SCF_2CF_2OCF_2CF_2SO_3]$ |
| 2-51 | $Ba[O_3SCF_2CF_2OCF_2CF_2SO_3]$ |

It is possible to synthesize the compounds represented by Formula (2a) with reference to the synthesis methods, known in the art, described in Journal of Fluorine Chemistry, 79 (1996), pages 33-38.

The fluorine compounds represented by Formula (2a) may be employed singly or in combinations of at least two types. It is preferable that of the constituting layers of the silver salt photothermographic dry imaging material, the fluorine compounds represented by Formula (2a) are employed in the backing layer according to the present invention. The added amount of the fluorine compounds represented by Formula (2a) is preferably 5-500 mg per $m^2$ of the heat developable photosensitive material, but is more preferably 20-300 mg.

In the silver salt photothermographic dry imaging materials of the present invention, in view of further exhibiting the targeted effects of the present invention, it is preferable that the backing layer according to the present invention incorporates fluorine based polymers represented by following Formula (3).

Formula (3)

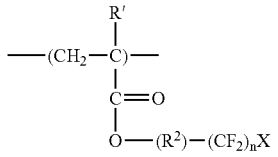

In above Formula (3), $R^1$ represents a hydrogen atom, a fluorine atom, or a methyl group; $R^2$ represents methylene, ethylene, or a 2-hydroxypropylene; and X represents a hydrogen atom or a fluorine atom; while n represents an integer of 1-4.

In the structure of the constituting units capable of being represented by Formula (3), the critical point is that n in above Formula (3) represents 1-4.

When viewed from the aspect of water-repellency, it has been considered that the number (n of Formula (2)) of carbon atoms of the perfluoro group of perfluoroacrylate or perfluoromethacrylate is generally at least 8. On the other hand, in the present invention, n is preferably in the range of 1-4 since it is thereby possible to improve the conveying properties which is a targeted effect of the present invention. Further, performance is exhibited in which an electrification rank controlling function is exhibited, anti-blocking properties are exhibited when heat and pressure are applied, desired compatibility with polymer binders constituting the existing layers is exhibited, and the desired solubility in solvents is realized.

It is possible to prepare the constituting units represented by above Formula (3) by polymerizing corresponding monomers such as fluoroalkyl acrylate, fluoroalkyl methacrylate, or fluoroalkyl α-fluoroacrylate.

Specifically, fluoroalkyl acrylate and fluoroalkyl methacrylate are commercially available from Daikin Chemical Sales Co., Ltd. Described in the catalog under Product Names are M-1110 (2,2,2-trifluoroethyl methacrylate), M-1210 (2,2,3,3,3-pentafluoropropyl methacrylate), M-1420 (2-(perfluorobutyl)ethyl methacrylate, M-1433 (3-(pentafluorobutyl)-2-hydroxypropyl), M-5210 (1H,1H,3H-tetrafluoropropyl methacrylate, M-5410 (1H,1H,5H-octafluoropropyl methacrylate), M-7210 (1H-1-(trifluoromethyl)trifluoroethyl methacrylate), M-7310 (1H,1H,3H-hexafluorobutyl methacrylate), R-1420 (3,3,4,4,5,5,6,6,6-nonafluorohexyl acrylate), A-1110 (2,2,2-trifluoroethyl acrylate), A-1210 (2,2,3,3,3-pentafluoropropyl acrylate), A-1420 (2-(perfluorobutyl) ethyl acrylate), A-1433 (3-(pentafluorobutyl)-2-hydroxypropyl, A-5210 (1H,1H,3H- tetrafluoropropyl acrylate), A-5410 (1H,1H,5H-octafluoropropyl acrylate-octafluoropropyl acrylate), A-7210 (1H-1-(trifluoromethyl)trifluoroethyl acrylate), and A-7310 (1H,1H,3H-hexafluorobutyl acrylate).

It is possible to prepare the fluorine based polymers having the above constituting units by copolymerizing with the acrylate monomers or methacrylate monomers represented by following Formula (4).

Formula (4)

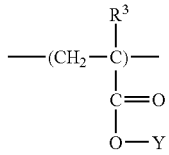

In above Formula (4), $R^3$ represents a hydrogen atom or a methyl group, while Y represents an alkyl group, an alicyclic group, or an aromatic ring group.

Specific examples include, but are not limited to, alkyl acrylates (for example, methyl acrylate, ethyl acrylate, butyl acrylate, propyl acrylate, n-hexyl acrylate, 2-ethylhexyl acrylate, iso-nonyl acrylate, n-dodecyl acrylate, or stearyl acrylate), benzyl acrylate, alkyl methacrylates (for example, methyl methacrylate (MMA), ethyl methacrylate, propyl methacrylate, butyl methacrylate, 2-ethylhexyl methacrylate, iso-nonyl methacrylate, dodecyl methacrylate, or a stearyl methacrylate), benzyl methacrylate, and cyclohexyl methacrylate, (HMA).

As constituting units having epoxy units capable of being further introduced in these constituting units, it is possible to achieve the introduction by copolymerizing glycidyl methacrylate (GMA), glycidyl acrylate, and vinylcyclohexane monoxide.

Specific examples of the fluorine based polymers which incorporate constituting components having the structure represented by Formula (4) as the constituting units will now be listed below, however, the present invention is not limited thereto.

4-1: M-1210(*)/M-5210(*)/MMA=1/1/1 (at mol ratio)

4-2: M-1210(*)/M-5210(*)/MMA=48/17/35 (at mol ratio)

4-3: R-1420(*)/CHMA=20/80 (at mol ratio)

4-4: R-1420(*)/CHMA=50/50 (at mol ratio)

*) Product Number of fluoroacrylates and fluoroalkyl methacrylates sold by above Daikin Chemicals Sales Co., Ltd.

MMA: methyl methacrylate

CHMA: cyclohexyl methacrylate

The added amount of fluorine based copolymers is preferably in the range of 1-100 mg per $m^2$ of the backing layer of the heat developable photosensitive materials, but is more preferably in the range of 2-50 mg.

Each constituting component of the silver salt photothermographic dry imaging materials of the present invention will now be described.

The silver salt photothermographic dry imaging material of the present invention incorporates a support having thereon a photosensitive layer incorporating photosensitive silver halide, organic silver salts, and reducing agents.

(Organic Silver: Non-Photosensitive Aliphatic Carboxylic Acid Silver Grains)

The organic silver salts according to the present invention are non-photosensitive organic silver salts capable of functioning as a supplying source of silver ions to form silver images in the photosensitive layer of the silver salt photothermographic dry imaging material.

Namely, in the presence of photosensitive silver halide grains (being photo-catalysts) having, on the grain surface, a latent image formed via exposure and reducing agents, the organic silver salts according to the present invention are those which can contribute to the formation of silver images via supplying silver ions while functioning as a silver ion supply source in the heat development process heated at 80° C. or higher Heretofore, known as such non-photosensitive organic silver salts have been silver salts of organic compounds of various structures, and employed as organic silver salts according to the present invention may be those disclosed in many of the patents in regard to silver salt photothermographic dry imaging materials. Preferably usable organic silver salts include silver salt particles of long chain aliphatic carboxylic acids. Specific examples include aliphatic carboxylic acid silver particles which are produced based on the production method described in JP-A No. 2003-270755, as well as chemical quality such as compositions of aliphatic carboxylic acid species such as behenic acid, stearic acid, arachidic acid, palmitic acid, or lauric acid incorporated in aliphatic carboxylic acid silver particles and physical quality such as a particle shape.

In view of storage stability of heat developed images, the content ratio of silver aliphatic carboxylates which are prepared employing, as a raw material, aliphatic carboxylic acids at a melting point of at least 50° C., but preferably at least 60° C., is preferably at least 50%, is more preferably at least 90%, but is still more preferably 90%. In this respect, it is preferable that the content ratio of silver behenate is higher.

Usable shapes of silver aliphatic carboxylate particles in the present invention are not particularly limited, and may be acicular, cylindrical, tabular or scaly. In the present invention, preferably employed are scaly silver aliphatic carboxylates and short needle-shaped or cuboid-shaped silver aliphatic carboxylate particles, at a ratio of the primary axis length to the secondary axis length of at most 5.

Further, an emulsion incorporating silver aliphatic carboxylate particles according to the present invention is a mixture of free aliphatic carboxylic acids, which form no salt, and silver aliphatic carboxylates. In view of image retention properties, it is preferable that the ratio of the former is lower than the latter. Namely, the aforesaid emulsion according to the present invention preferably incorporates aliphatic carboxylic acid in an amount of 3-10 mol % with respect to the aforesaid silver aliphatic carboxylate particles, but most preferably in an amount of 4-8 mol %.

Prior to production of silver aliphatic carboxylates, it is necessary to prepare alkali metal aliphatic carboxylates. In such a case, examples of the usable types of alkali metal salts include sodium hydroxide, potassium hydroxide, and lithium hydroxide. Of these, it is preferable to employ one type of the alkali metals such as potassium hydroxide, but it is also preferable to employ sodium hydroxide together with potassium hydroxide. The combination ratio is preferably in the range of 10:90-75:25 in terms of mol ratio of both of the above hydroxide salts. When alkali metal aliphatic carboxylates are formed via reaction with aliphatic carboxylic acids and used in the above range, it is possible to control the viscosity of the reaction liquid to the optimal level.

It is possible to use the desired amount of silver aliphatic carboxylate particles according to the present invention. The amount in terms of silver weight is preferably 0.1-5 $g/m^2$, is more preferably 0.3-3 $g/m^2$, but is still more preferably 0.5-2 $g/m^2$.

Photosensitive silver halide (in the photographic industry, simply referred to as silver halide grains or silver halide) according to the present invention, as described herein, refers to silver halide crystal grains which are capable of inherently absorbing radiation being an intrinsic characteristic, also capable of artificially allowing visible light and infrared rays to be absorbed employing physicochemical methods, and which are process-produced so that physicochemical changes can occur in the interior of silver halide crystals, or on the crystal surface, when any of the radiation from the ultraviolet region to the infrared region is absorbed.

Employed as the photosensitive silver halide grains according to the present invention may be silver halide grains disclosed in many of the conventional patents in regard to silver salt photothermographic dry imaging materials. Specific examples of preferred usable silver halide grains include those obtainable by the production method described, for example in JA-A No. 2003-270755, in which production is carried out based on chemical properties such as a halogen composition, as well as physical properties such as a shape.

Halogen compositions are not particularly limited and any of silver chloride, silver chlorobromide, silver chloroiodobromide, silver iodide, silver iodobromide, and silver iodide are usable, of which silver bromide, silver iodobromide, or silver iodide is preferred.

In order to minimize cloudiness after image formation and to result in excellent image quality, it is preferred to appropriately reduce the diameter of silver halide grains. When grains at an average diameter of less than 0.02 μm are excluded from determination, the diameter is preferably 0.030-0.055 μm.

Cited as shapes of silver halide grains may be cubic, octahedral, tetradecahedral, planar, cubic, cylindrical, and rough ovoid. Of these, particularly preferred are cubic, octahedral, tetradecahedral, and planar silver halide grains.

It is preferable to employ the photosensitive silver halide grains according to the present invention in an amount of 0.001-0.7 mol with respect to mol of silver aliphatic carboxylates capable of functioning as a silver ion supply source, but it is more preferably to employ the same in an amount of 0.3-0.5 mol.

(Thermal Conversion Internal Latent Image Type Silver Halide Grains)

Photosensitive silver halide grains according to the present invention are preferably thermal conversion internal latent image type (internal latent image type after heat development) silver halide grains, disclosed in JP-A No. 2003-270755 and Japanese Patent Publication No. 2003-337269, namely silver halide grains which result in a decrease in surface photographic speed via conversion from the surface latent image type to the internal latent image type via heat development. In other words, in view of photographic speed and image retention properties, silver halide grains are preferred in which pre-development exposure to light forms on the surface of silver halide grains, latent images capable of functioning as a catalyst of development reaction (being a reduction reaction of silver ions employing silver ion reducing agents), and exposure to light after the heat development process forms more latent images in the interior of the silver halide grains than the surface, whereby the latent image formation on the surface is retarded.

The thermal conversion internal latent image type silver halide grains according to the present invention are employed in the same manner as common surface latent image type silver halide grains in a preferable amount of 0.001-0.7 mol per mol of silver aliphatic carboxylates capable of functioning as a silver ion supply source, but preferably being 0.03-0.5 mol.

(Silver Halide Particle Dispersion Technology)

During the production process of the silver salt photothermographic imaging material of the present invention, in view of enhancement of photographic performance and image tone, it is preferable to minimize coagulation of silver halide grains, resulting in relatively uniformly dispersed silver halide grains so that it is possible to eventually control developed silver of the desired shape.

For the above minimization of coagulation and uniform dispersion, gelatin employed in the present invention is preferred in which hydrophilic groups such as an amino group or a carboxyl group, incorporated in the gelatin, is chemically modified corresponding to the employed conditions.

For example, listed as hydrophilic modification of the amino group in the gelatin molecule are phenylcarbamoylization, phthalization, succination, acetylation, benzoylization, and nitrophenolization, however is not limited particularly thereto. The substitution ratio of any of these is preferably at least 95%, but is more preferably at least 99%. Further, hydrophobic modification of the carboxylic group may be combined, and methyl esterification and amidization are also listed, however the modification is not limited thereto. The substitution ratio of the carboxyl group is preferably 50-90%, but is more preferably 70-90%. "Hydrophobic group of the hydrophobic modification", as described above, means that hydrophobicity of gelatin is increased by substituting the amino group and/or the carboxylic group.

Further, depending on the object, it is preferable to prepare the silver halide grain emulsion according to the present invention, employing the following polymers, which are soluble in both water and organic solvents, instead of gelatin or together with gelatin. For example, it is particularly preferred that a silver halide grain emulsion is uniformly dispersed in an organic solvent system, and then coated.

Listed as the above organic solvents are alcohol based, ester based, and ketone based compounds. Of these, particularly preferred are ketone based organic solvents such as acetone, methyl ethyl ketone, or diethyl ketone.

The above polymers, which are soluble in both water and organic solvents, may be any of the natural polymers as well as synthetic polymers and copolymers. For example, gelatin or rubber may be modified to the applicable category. Further, it is possible to employ polymers belonging to the following classification while functional groups which are suitable for minimizing coagulation and achieving uniform dispersion are introduced.

Examples of the above polymers according to the present invention include poly(vinyl alcohols), hydroxyethyl celluloses, cellulose acetates, cellulose acetate butyrates, poly(vinylpyrrolidones), casein, starch, poly(acrylates or methacrylates), poly(methyl methacrylates and methacrylates), poly (vinyl chlorides), poly(methacrylic acids), styrene-maleic anhydride copolymers, styrene-acrylonitrile copolymers, styrene-butadiene copolymers, poly(vinyl acetals) (for example, poly(vinyl formal) or poly(vinyl butyral), poly(esters), poly(urethanes), phenoxy resins, poly(vinylidene chlorides), poly(epoxides), poly(carbonates), poly(vinyl acetates), poly(olefins), and poly(amides).

Several types of these polymers may be employed to prepare desired copolymers, but copolymers prepared by copolymerizing monomers of acrylic acid, methacrylic acid and esters thereof are particularly preferred.

The above polymers according to the present invention include those which are soluble in both water and organic solvents in the same state, but also include those which can be modified to be soluble or insoluble in water or organic solvents by controlling the pH and temperature.

For example, polymers having an acidic group, such as a carboxyl group, become hydrophilic in the dissociated state depending on the type, but when they are modified to the non-dissociated state by lowering the pH, they become oleophilic and soluble in solvents. On the contrary, polymers having an amino group become oleophilic when the pH is increased, while when the pH is lowered, they are ionized to result in an increase in water solubility.

It is common knowledge that nonionic surface active agents exhibit the phenomenon of "cloud point". The above polymers include those which exhibit the following properties. When the temperature is increased, they become oleophilic and soluble in organic solvents, while when the temperature is lowered, they become hydrophilic, namely soluble in water. They are applicable if they are uniformly emulsified forming micelles without reaching complete dissolution.

In the present invention, it is not possible to mention any definite employed amount of each monomer since various types of monomers are combined. However, it is easily seen that targeted polymers are prepared by combining hydrophilic monomers and hydrophobic monomers at an appropriate ratio.

Preferred as the above polymers, which are soluble in both water and organic solvents, are those which exhibit a solubility in water of at least 1% by weight (at 25° C.) under controlled or non-controlled conditions during dissolution, and exhibit a solubility in methyl ethyl ketone, serving as an organic solvent of at least 5% by weight (at 25° C.).

In view of solubility, suitable polymers according to the present invention, which are soluble in both water and organic solvents, include so-called block polymers, graft polymers, and comb-type polymers, rather than straight chain polymers, of which the comb-type polymers are particularly preferred.

The isoelectric point of the polymers is preferably at a pH of less than or equal to o 6.

During the production process of the silver salt photothermographic dry imaging material of the present invention, to minimize coagulation of the aforesaid silver halide grains and achieve uniform dispersion, it is also preferable to incorporate surface active agents, specifically nonionic surface active agents, into a silver halide grain dispersion.

Nonionic surface active agents, as described herein, are generally selected from nonionic hydrophilic compounds having −18 to 18 or preferably −15 to 0 which exhibits the hydrophilicity/oleophilicity equilibrium defined as a "HLB" value, which in turn reflects the ratio of the hydrophilic group and the oleophilic group in a molecule, based on Griffin W. C., J. Soc. Cosm. Chem., 1, 311 (1949).

Preferred as nonionic surface active agents which are employed in the photosensitive silver halide emulsion according to the preset invention are those represented by following Formulas (NSA1) and (NBA2).

$$HO\text{-}(EO)_a\text{-}(AO)_b\text{-}(EO)_c\text{—}H \qquad \text{Formula (NSA1)}$$

$$HO\text{-}(AO)_d\text{-}(EO)_e\text{-}(AO)_f\text{—}H \qquad \text{Formula (NSA2)}$$

wherein EO represents an oxyethylene group, AO represents an oxyalkylene group having at least 3 carbon atoms, and each of a, b, c, d, e, f represents an integer more than 1.

Any of these compounds are called PLURONIC type nonionic surface active agents. In Formula (NSA1) or (NSA2), examples of the oxyalkylene group having at least 3 carbon atoms represented by AO include an oxypropylene group, an oxybutylene group, and an oxyalkylene group having a long chain, of which the oxypropylene group is most preferred.

Further, a, b, and c each represents an integer of at least 1 and d, e, and f each also represents an integer of at least 1. Each of a and c is preferably 1-200, but is more preferably 10-100, while b is preferably 1-300, but is more preferably 10-200. Each of d and f is preferably 1-100, but is more preferably 5-50, while e is preferably 1-100, but is more preferably 2-50.

In the photosensitive silver halide emulsions according to the present invention, employed are macrocyclic compounds containing a heteroatom(s). Macrocyclic compounds containing heteroatom(s) refer to at least 9-membered ring compounds containing at least one heteroatom such as a nitrogen atom, an oxygen atom, a sulfur atom or a selenium atom. Further, a 12- to 24-membered ring is preferred, but a 15- to 21-membered ring is more preferred.

Representative compounds are those known as crown ethers. These compounds are detailed in C. J. Pederson, Journal of American Chemical Society, Vol. 68 (2495), 7017-7036 (1967), G. W. Gokel and S. H. Korzeniowski, "Macrocyclic Polyether Synthesis", Springer-Vergal, (1982), "Crown Ether no Kagaku (Crown Ether Chemistry)", edited by Oda, Shono, and Tabushi, Kagakudonin (1978), "Host-Guest", edited by Tabushi, Kyoritsu Shuppan Sha (1979), and Sasaki and Koga, "Journal of Synthetic Organic Chemistry, Japan", Vol. 45 (6), 571-582 (1987).

(Chemical Sensitization)

It is possible to apply, to the photosensitive silver halide gains according to the present invention, chemical sensitization which has been disclosed in many patents in regard to silver salt photothermographic dry imaging materials. It is possible to form and provide chemical sensitization centers (being chemical sensitization nuclei), capable of capturing electrons or positive holes generated via photo-excitation of photosensitive silver halide grains or spectral sensitizing dyes on the particles thereof, utilizing compounds releasing chalcogens such as sulfur, selenium, or tellurium, and noble metal compounds releasing noble metal ions such as gold ions, employing the methods described, for example, in JP-A Nos. 2003-270755, 2001-249428, and 2001-249426. It is specifically preferable that the above emulsion has undergone chemical sensitization employing organic sensitizers containing chalcogen atoms.

Organic sensitizers containing such chalcogen atoms are preferably compounds having a group capable of being adsorbed onto silver halide grains and onto unstable chalcogen atom portions.

Employed as such organic sensitizers may be those having various structures, disclosed in JP-A Nos. 60-150046, 4-109240, 11-218874, 11-218875, 11-218876, and 11-194447. Of these, it is preferable to employ at least one of the compounds having a structure in which the chalcogen atom is bonded to a carbon atom or a phosphor atom to result in a double bond. Specifically preferred are thiourea derivatives having a heterocyclyl group, and triphenylphosphine sulfide derivatives.

It is preferable that when the surface of photosensitive silver halide grains according to the present invention undergoes chemical sensitization, the above chemical sanitization effects are substantially eliminated after the heat development process. "Chemical sensitization effects are eliminated", as described herein, means that after the heat development process, the photographic speed of the above imaging material, prepared employing the above chemical sensitization techniques, decreases by a factor of at most 1.1, compared to the photographic speed of the same which have not undergone chemical sensitization. Further, in order to eliminate chemical sensitization effects during the heat development process, it is necessary to incorporate, in the emulsion layer or/and the non-photosensitive layer, oxidizing agents in an appropriate amount, to enable destroying chemical sensitization centers (chemical sensitization nuclei) via oxidation reaction during heat development, such as the aforesaid halogen radical releasing compounds. It is preferable to control the content of the above oxidizing agents while considering the oxidizing power of the oxidizing agents, and the desired decrease range of the chemical sensitization effects.

(Spectral Sensitization)

It is preferable that the photosensitive silver halide grains according to the present invention undergo spectral sensitization while spectral sensitizing dyes are adsorbed. Employed as spectral sensitizing techniques are those which employ, as a spectral sensitizing dye, cyanine dyes, merocyanine dyes, complex cyanine dyes, complex merocyanine dyes, homopolar cyanine dyes, styryl dyes, hemicyanine dyes, oxonol dyes, and hemioxonol dyes which have been disclosed in many patents related to silver salt photothermographic dry imaging materials.

Specific examples of spectral sensitizing techniques which are applicable to the silver salt photothermographic dry imaging materials of the present invention include a technique based on the spectral sensitizing technique in which at least one type of the sensitizing dyes is selected for use from those represented by Formulas (1) and (2) described in JP-A No. 2004-309758.

Materials such as dyes which exhibit no spectral sensitization and substances which do not substantially absorb visible light, which result in supersensitization, may be incorporated in an emulsion incorporating photosensitive silver halide grains and silver aliphatic carboxylate particles of the present invention, whereby the above silver halide grains may undergo supersensitization.

Useful sensitizing dyes, combinations of dyes exhibiting supersensitization, and substances exhibiting supersensitization are described in Research Disclosure (hereinafter referred to as RD) 17643 (issued December 1978) page 23, Item J of IV, Japanese Patent Publication Nos. 9-25500 and 43-4933, and JP-A Nos. 59-19032, 59-192242, and 5-341432. Of these, preferred as a supersensitizer are heteroaromatic mercapto compounds or mercapto derivatives.

Other than the above supersensitizers, employed as a supersensitizer may also be macrocyclic compounds having a heteroatom, as disclosed in JP-A No. 2001-330918.

It is preferable that spectral sensitization is achieved by allowing spectral sensitizing dyes to adhere onto the surface of the photosensitive silver halide grains according to the present invention, and after the heat development process, the above spectral sensitization effects are substantially eliminated. "Spectral sensitization effects are substantially eliminated", as described herein, means that the photographic speed of the aforesaid imaging materials, which is achieved by employing sensitizing dyes and supersensitizers, decreases after the heat development process by a factor of at most 1.1, compared to that of the materials which have not undergone such spectral sensitization.

In order to eliminate spectral sensitization effects during the heat development process, it is necessary to employ spectral sensitizing dyes which are easily released from silver halide grains or/and to incorporate, in the emulsion layer or/and the non-photosensitive layer of the aforesaid imaging material, oxidizing agents, in an appropriate amount, capable of destroying spectral sensitizing dyes via an oxidation reaction, such as the aforesaid halogen radical releasing compounds. It is preferable to control the content of the above oxidizing agents while considering the oxidizing power of the oxidizing agents, and the decrease range of the chemical sensitization effects.

(Silver Ion Reducing Agents)

The reducing agents according to the present invention are those capable of reducing silver ions in the photosensitive layer and are also called developing agents. Listed as such reducing agents are the compounds represented by following Formula (RD1).

In the present invention, it is preferable that reducing agents of silver ions which are the compounds represented by following Formula (RD1) are employed individually or in a combination with reducing agents having different chemical structures.

Formula (RD1)

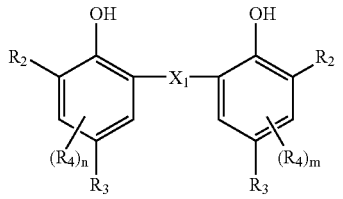

In above Formula (RD1), $X_1$ represents a chalcogen atom or $CHR_1$ wherein $R_1$ represents a hydrogen atom, a halogen atom, an alkyl group, an alkenyl group, an aryl group, or a heterocyclyl group; $R_2$ represents an alkyl group, which may be the same or different; $R_3$ represents a hydrogen atom or a group capable of being substituted for a benzene ring; $R_4$ represents a group capable of being substituted for a benzene ring; and each of m and n represents an integer of 0-2.

After preparing silver salt photothermographic dry imaging materials which result in high density and excellent lightfastness, of the compounds represented by Formula (RD1), it is preferable to employ highly active reducing agents (hereinafter referred to as (RD1a) compounds) in which at least one of $R_2$ is a secondary or tertiary alkyl group. In the present invention, in order to achieve desired image tone, it is preferable that the (RD1a) compounds are employed together with the compounds represented by following Formula (RD2).

Formula (RD2)

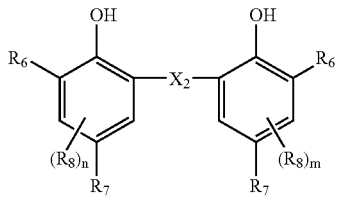

In above Formula (RD2), $X_2$ represents a chalcogen atom or $CHR_5$ wherein $R_5$ represents a hydrogen atom, a halogen atom, an alkyl group, an alkenyl group, an aryl group, or a heterocyclyl group; $R_6$ represents an alkyl group which may be the same or different, but represents neither a secondary nor a tertiary alkyl group; $R_7$ represents a hydrogen atom or a group capable of being substituted for a benzene ring; $R_8$ represents a group capable of being substituted for a benzene ring; and each of m and n represents an integer of 0-2.

The ratio, {weight of (RD1a) compounds}:{weight of the compounds represented by Formula (RD2)} is preferably 5:95-45:55, but is more preferably 10:90-40:60.

(Image Tone)

The tone of images formed by applying a heat development process to silver salt photothermographic dry imaging materials will now be described.

In regard to the tone of outputted images for medical diagnosis such as conventional radiographs, it has been stated that blue-black image tone enables observers to more easily obtain accurate diagnostic observed results. "Blue-black image tone", as described herein, refers to pure black tone or blue-black tone such that basically black images are slightly tinted with blue. On the other hand, warm-black image tone is stated to be a tone such that basically black images are slightly tinted with brown. In order to discuss this matter more precisely and quantitatively, description will now be made based on the expression method recommended by Commission Internationale de I'Eclairage (CIE).

It is possible to describe the image tone terms, "more blue-black tone" and "warmer-black tone" based on hue angle hab at minimum density Dmin and optical density D of 1.0. Namely, the hue angle hab is obtained based on the following formula, employing color coordinates a* and b* of L*a*b* color space which is a color space having perceptionally uniform pace, which was recommended by Commission Internationale de I'Eclairage (CIE) in 1976.

$$hab=\tan^{-1}(b^*/a^*)$$

Investigation was conducted employing the representation method based on the above hue angle. As a result, it has been found that the hue angle hab of the image tone after development of the photothermographic dry imaging material of the present invention is preferably in the range of 180 degrees<hab<270 degrees, is more preferably in the range of 200 degrees<hab<270 degrees, but is most preferably in the range of 220 degrees<hab<260 degrees. This is disclosed in JP-A No. 2002-6463.

Heretofore, it is has been known that by controlling, to the specified numerical values, u* and v*, or a* and b* in CIE 1976 (L*a*b*) color space or (L*a*b*) color space at an optical density of nearly 1.0, it is possible to prepare diagnostic images which exhibit visually preferable tone. The above is described, for example, in JP-A No. 2000-29164.

However, as disclosed in JP-A No. 2004-94240, it has been found that in regard to the silver salt photothermographic dry imaging materials of the present invention, when in CIE 1976 (L*u*v*) color space or (L*a*b*) color space, a linear regression line is formed by plotting u* and v*, or a* and b* at various photographic densities on a graph in which the abscissa represents u* or a*, and the ordinate represents v* or b*, it is possible to provide diagnosis properties which are equal to or even better than those of conventional wet system silver salt photosensitive materials. The preferably specified condition range will now be described.

(1) Determination coefficient (multiple determination) $R^2$ of the linear regression line which is formed by plotting u* and v* at each of the densities of 0.5, 1.0 and 1.5, as well as the minimum density of the silver image which is prepared via the heat development process of a silver salt photothermographic dry imaging material on a 2-dimensional coordinate, in which the abscissa of CIE 1976 L*u*v* color space represents u* and the ordinate of the same represents v* is preferably 0.998-1.000. Further, it is preferable that v* value at the intersection of the above linear regression line with the ordinate is −5 to 5, and gradient (v*/u*) is 0.7-2.5.

(2) Determination coefficient (multiple determination) $R^2$ of the linear regression line which is formed by plotting a* and b* at each of the densities of 0.5, 1.0 and 1.5, as well as the minimum density of the silver image, which is prepared via the heat development process of a silver salt photothermographic dry imaging material, on a 2-dimensional coordinate in which the abscissa of CIE 1976 L*a*b* color space represents a* and the ordinate of the same represents b*, is preferably 0.998-1.000. Further, it is preferable that b* value at the intersection of the above linear regression line with the ordinate is −5 to 5, and gradient (b*/a*) is 0.7-2.5.

A preparation method of the above linear regression line, namely one example of the determination method of u* and v* as well as a* and b* in the CIE 1976 color space, will now be described.

By employing a thermal processor, a 4-step wedge sample including an unexposed portion and optical densities of 0.5, 1.0 and 1.5 is prepared. Each of the wedge density portions, prepared as above, is determined employing a color photometer (such as CM-3600d, produced by Minolta Co., Ltd.), and u* and v*, or a* and b* are calculated. The above determination is performed employing a transmission determination mode under conditions of employing an F7 light source as a light source at a viewing angle of 10 degrees. Determined u* and v* or a* and b* are plotted on a graph in which the abscissa represents u* or a*, while the ordinate represents v* or b* and a linear regression line is obtained, whereby determination coefficient (multiple determination) $R^2$, an intercept, and a gradient are obtained.

A specific method to obtain the linear regression line exhibiting the above features will now be described.

In the present invention, it is possible to realize preferred image tone via optimization of the developed silver shape by controlling the addition amount of the compounds directly or indirectly involved in the development reaction process, such as reducing agents (developing agents), silver halide grains, silver aliphatic carboxylates, and the toners described below. For example, when developed silver is controlled to be dendritic, the resulting image tends to be bluish, while when it is controlled to be filamentary, the resulting image tends to be yellowish. Namely, it is possible to control the image tone upon considering such properties of the shape of developed silver.

Heretofore, commonly employed as toners have been phthalazinone or phthalazine and phthalic acids, as well as phthalic anhydrides. Examples of appropriate toners are disclosed in RD 17029, as well as U.S. Pat. Nos. 4,123,282, 3,994,732, 3,846,136, and 4,021,2439.

Other than such toners, it is possible to control image tone, employing couplers disclosed in JP-A No. 11-288057 and European Patent No. 1,134,611A2, as well as the leuco dyes detailed below. Specifically, it is preferable to employ couplers or leuco dyes to achieve precise control of the image tone.

(Leuco Dyes)

As described above, it is also possible via leuco dyes to control the image tone of the silver salt photothermographic dry imaging materials of the present invention. Preferably employed as such leuco dyes may be any of the colorless or slightly colored compounds which are oxidized to be colored upon being heated in the temperature range of about 80-about 200° C. for about 0.5-about 30 seconds. It is possible to employ any of the leuco dyes which are oxidized by the oxidants of the aforesaid reducing agents to form dyes. Compounds are useful which exhibit pH sensitivity and can be oxidized into a colored state.

Leuco dyes, which are preferably employed in the present invention, are not particularly limited, and examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Useful leuco dyes include those disclosed in U.S. Pat. Nos. 3,445,234, 3,846,136, 3,994,732, 4,021,2549, 4,021,250, 43,022,617, 4,123,282, 4,368,247, and 4,461,681, as well as JP-A Nos. 50-36110, 59-206831, 5-204087, 11-231460, 2002-169249, and 2002-236334.

In order to achieve specified image tone, it is preferable that various colored leuco dyes are employed individually or in combinations of a plurality of types. In the present invention, in order to minimize variation of image tone (specifically yellowish) depending on the used amount and used ratio, along with the usage of highly active reducing agents, and also to minimize the formation of excessively reddish image at a high density of at least 2.0 due to the use of minute silver halide grains, it is preferable to simultaneously use leuco dyes which are colored yellow and cyan, respectively and to control the used amount thereof.

It is preferable that image density is appropriately controlled in relationship with the image tone due to the developed silver itself. In the present invention, it is preferable that formed color results in an optical reflection density of 0.01-0.05 or in an optical transmission density of 0.005-0.50 and the image tone is controlled to within the above preferred image tone range. In the present invention, it is preferable to form color so that the total sum of the maximum densities at the maximum absorption wavelength of dye images formed via leuco dyes is preferably 0.01-0.50, is more preferably 0.02-0.30, but is 0.03-1.0.

(Binders)

In silver salt photothermographic dry imaging materials of the present invention, it is possible to incorporate, in photosensitive layers and non-photosensitive layers, binders to achieve various aims.

Binders incorporated in the photosensitive layer according to the present invention carry organic silver salts, silver halide grains, reducing agents, and other components. Suitable binders are transparent or translucent and generally colorless and include natural polymers, synthetic polymers, as well as other film forming media such as those described in paragraph [0069] of JP-A No. 2001-330918.

Of these, listed as particularly preferable examples are alkyl methacrylates, aryl methacrylates, and styrenes. In such polymer compounds, it is preferable to use polymer compounds having an acetal group. Of polymer compounds having such an acetal group, polyvinyl acetal having an acetacetal structure is more preferred and examples include polyvinyl acetal disclosed in U.S. Pat. Nos. 2,358,836, 3,003,879, and 2,828,204, as well as British Patent No. 771,155.

Particularly preferred as the polymer compounds having an acetal group are those represented by Formula (V) described in [150] of JP-A No. 2002-287299.

Preferable binders for the photosensitive layer according to the present invention include polyvinyl acetals, of which polyvinyl butyral is particularly preferred and preferably employed as a major binder. "Major binder", as described herein, means that the aforesaid binder occupies at least 50% by weight of the total binders in the photosensitive layer. Accordingly, the other polymers may be blended in the range of less than 50% by weight of the total binders. These polymers are not particularly limited in the present invention as long as they are soluble in solvents. More preferably listed are polyvinyl acetate, polyacrylic resins, and urethane resins.

In view of reaching the sufficient maximum density during image formation, the glass transition temperature (Tg) of binders employed in the present invention is preferably 70-105° C.

In the present invention, the number average molecular weight of the binders is commonly 1,000-1,000,000, but is preferably 10,000-500,000, while the degree of polymerization is about 50-about 1,000.

Further, preferably employed in an upper coating layer as well as in a lower coating layer, particularly non-photosensitive layers such as a protective-layer or a backing layer, are polymers such as cellulose esters which exhibit a higher softening temperature, particularly triacetyl cellulose or cellulose acetate butyrate. If desired, as noted above, it is possible to employ at least two types of binders in combination.

Such binders are employed in an effective amount range in which they function as a binder.

It is possible for a person skilled in the art to easily determine the above effective range. For example, as an index in the case of retaining organic silver salts in the photosensitive layer, the ratio of the binders to the organic silver salts is preferably in the range of 15:1-1:2 (in terms of weight ratio), but is most preferably in the range of 8:1-1:1. Namely, the binder amount of the photosensitive layer is preferably 1.5-6 $g/m^2$, but is more preferably 1.5-5 $g/m^2$. When it is less than 1.5 $g/m^2$, the density of the unexposed portion increases excessively resulting occasionally in no commercial viability.

Organic gelling agents may be incorporated in the photosensitive layer. "Organic gelling agent", as described herein, refers to compounds such as polyhydric alcohols which result in a yielding value of the organic liquid system when added to it and eliminate or decrease the fluidity of the above system.

An embodiment is also preferred in which a photosensitive layer liquid coating composition incorporates a water-based dispersed polymer latex. In such an embodiment, at least 50% by weight of all binders in the photosensitive layer liquid coating composition is preferably the water based dispersed polymer latex. Further, when polymer latexes are employed during preparation of the photosensitive layer, it is preferable that at least 50% by weight of the all binders in the photosensitive layer are polymers derived from the polymer latexes, but it is more preferable that at least 70% by weight of the all binders are polymers derived from the same as above.

(Crosslinking Agents)

It is possible to incorporate, in the photosensitive layer according to the present invention, crosslinking agents capable of connecting binders via bridging. By employing crosslinking agents in the above binders, it is known that layer adhesion is enhanced and uneven development is minimized. In addition, fog formation during storage is minimized and formation of print-out silver after development is also retarded.

Employed crosslinking agents include various ones, employed for light-sensitive photographic materials, such as aldehyde based, epoxy based, ethyleneimine based, vinylsulfone based, sulfonic acid ester based, acryloyl based, carbodiimide based, and silane compound based crosslinking agents, as disclosed in JP-A No. 50-96216. Of these, preferred are the following isocyanate based, silane compound based, epoxy based compounds or acid anhydrides.

The isocyanate based crosslinking agents are isocyanates and adducts thereof having at least two isocyanate groups. More specifically, listed are aliphatic diisocyanates, aliphatic diisocyanates having a ring group, benzene isocyanates, naphthalene isocyanates, biphenyl isocyanates, diphenylmethane diisocyanates, triphenylmethane diisocyanates, triisocyanates, and tetraisocyanates, as well as adducts of these isocyanates, and adducts of these isocyanates with dihydric or trihydric polyalcohols. Employed as specific examples may be isocyanate compounds described on pages 10-12 of JP-A 56-5535.

Further, adducts of isocyanate with polyalcohol particularly enhance adhesion between layers and exhibit high capability of minimizing layer peeling, image shifting, and air bubble formation. Such isocyanates may be placed in any portion of silver salt photothermographic dry imaging materials. They may be incorporated, for example, in the support (when the support is composed of paper, they may be incorporated in the sizing composition), and in any of the photosensitive layer, the surface protective layer, the interlayer, the antihalation layer, or the sublayer on the photosensitive layer side and in any of one or at least two layers among them.

Further, as thioisocyanate based crosslinking agents usable in the present invention, also useful are compounds having a thiocyanate structure corresponding to the above isocyanates.

The used amount of the above crosslinking agents is commonly in the range of 0.001-2 mol per mol of silver, but is preferably in the range of 0.005-0.5 mol.

Isocyanate compounds and isothiocyanate compounds which may be incorporated in the present invention are preferably those which function as the above crosslinking agent. However, compounds which have only one of the aforesaid functional group yield desired results.

Examples of silane compounds include the compounds represented by Formulas (1)-(3), disclosed in JP-A No. 2001-264930.

Further, epoxy compounds which are usable as a crosslinking agent may be those having at least one epoxy group, and the number of the epoxy groups and the molecular weight are not limited. It is preferable that the epoxy group is incorporated in the molecule as a glycidyl group via an ether bond or an imino bond. Further, epoxy compounds may be any of the monomer, oligomer, or polymer. The number of epoxy groups incorporated in the molecule is commonly about 1-about 10, but is preferably 2-4. When epoxy compounds are polymers, they may be homopolymers or copolymers. The number average molecular weight Mn is most preferably in the range of about 2,000-20,000.

Acid anhydrides employed in the present invention are compounds having at least one acid anhydride group, represented by the structure below. Those having at least one such acid anhydride group are usable, and the number of the acid anhydride groups and the molecular weight are not limited.

—CO—O—CO—

The above epoxy compounds and acid anhydrides may be employed individually or in combinations of at least two types. The addition amount is not particularly limited, but is preferably in the range of $1\times10^{-6}$-$1\times10^{-2}$ mol/m$^2$, but is more preferably in the range of $1\times10^{-5}$-$1\times10^{-3}$ mol/m$^2$. These epoxy compounds and acid anhydrides may be incorporated in any of the layers on the photosensitive layer side, such as the photosensitive layer, the surface protective layer, the antihalation layer, or the sublayer and in one or at least two layers of the above layers.

(Silver Saving Agents)

Silver saving agents may be incorporated in the photosensitive layers and non-photosensitive layers according to the present invention. "Silver saving agent", as described herein, refers to compounds capable of decreasing the silver amount which is necessary to achieve definite silver image density.

Even though several working mechanisms of function to decrease the above necessary silver amount are assumed, compounds are preferred which enhance the covering power of developed silver. "Covering power of developed silver", as described herein, refers to optical density per unit amount of silver. The above silver saving agents may be incorporated in the photosensitive layer or the non-photosensitive layer, or in both of them. Examples of preferable silver saving agents include hydrazine derivatives, vinyl compounds, phenol derivatives, naphthol derivatives, quaternary onium compounds and silane compounds. Listed as specific examples are silver saving agents disclosed in paragraphs [0195]-[0235] of JP-A No. 2003-270756.

Particularly preferred silver saving agents, as those according to the present invention, are the compounds represented by following Formulas (SE1) and (SE2).

$Q_1$-NHNH-$Q_2$ Formula (SE1)

In above Formula (SE1), $Q_1$ represents a carbon atom portion which is an aromatic group or a heterocyclyl group bonding to —NHNH-$Q_2$, while $Q_2$ represents a carbamoyl group, an acyl group, an alkoxycarbonyl group, an aryloxycarbonyl group, a sulfonyl group, or a sulfamoyl group.

Formula (SE2)

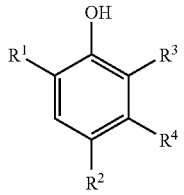

In above Formula (SE2), $R^1$ represents an alkyl group, an acyl group, an acylamino group, a sulfonamido group, an alkoxycarbonyl group, or a carbamoyl group; $R^2$ represents a hydrogen atom, a halogen atom, an alkyl group, an alkoxy group, an aryloxy group, an alkylthio group, an arylthio group, an acyloxy group, a carbonic acid ester group; $R^3$ and $R^4$ each represents a group capable of being substituted for a benzene ring; and $R^3$ and $R^4$ may be joined to form a condensed ring.

When $R^3$ and $R^4$ are joined to form a condensed ring in Formula (SE2), the resulting condensed ring is preferably a naphthalene ring. When Formula (SE2) represents naphthol based compounds, $R^1$ is preferably any of the carbamoyl groups, of which a benzoyl group is particularly preferred. $R^2$ is preferably an alkoxy group or an aryloxy group, of which the alkoxy group is particularly preferred.

(Heat Solvents)

It is preferable that the silver salt photothermographic dry imaging materials of the present invention incorporate heat solvents. "Heat solvent", as described herein, is defined as a component capable of lowering the heat development temperature of the silver salt photothermographic dry imaging materials by at least 1° C., compared to that of the silver salt photothermographic dry imaging material which incorporates no heat solvents. The components capable of lowering the heat development temperature by at least 2° C. are more preferred, but those capable of lowering the heat development temperature by at least 3° C. are most preferred. For example, a photothermographic dry imaging material which incorporates an assumed heat solvent is designated as A, and a photothermographic dry imaging material which has the same composition as A except for the assumed heat solvent is designated as B. B is exposed to light and heat-developed at 120° C. for 20 seconds. Then the resulting density is determined. A is then exposed under the same exposure amount as B. If A results in the same density as B at a heat development temperature of 119° C. or lower, the compound incorporated in A is defined as a heat solvent.

Heat solvents incorporate polar group(s) and substituent(s). The compounds represented by Formula (TS) are preferred but are not limited thereto.

$(Y)_nZ$ Formula (TS)

In Formula (TS), Y represents an alkyl group, an alkenyl group, an alkynyl group, an aryl group, or a heterocyclyl group; Z represents a hydroxyl group, a carboxyl group, an amino group, an amido group, a sulfonamido group, a phosphoric acid amido group, and a cyano group, as well as a group selected from imido, ureido, sulfoxide, sulfon, phosphine, phosphinoxide, or a nitrogen-containing heterocyclic group; n represents an integer of 1-3; and when Z represents a univalent group, n represents 1, while when Z is a divalent or higher group, n is the same as the valence of Z; and when n is at least 2, a plurality of Y may be the same or different.

Y may further have a substituent(s) which may be represented by Z. Y will now be further detailed. In Formula (TS), Y represents a straight or branched cyclic alkyl group (having preferably 1-40 carbon atoms, more preferably 1-30, but most preferably 1-25, and including, for example, methyl, ethyl, n-propyl, iso-propyl, sec-propyl, t-butyl, t-octyl, n-amyl, t-amyl, n-dodecyl, n-tridecyl, octadecyl, icosyl, docosyl, cyclopentyl, and cyclohexyl); an alkenyl group (having preferably 2-40 carbon atoms, more preferably 2-30, but most preferably 2-25, and including, for example, vinyl, allyl, 2-butenyl, and 3-pentenyl); an aryl group (having preferably 6-40 carbon atoms, more preferably 6-30, but most preferably 6-25, and including, for example, phenyl, p-methylphenyl, and naphthyl); a heterocyclyl group (having preferably 2-20 carbon atoms, more preferably 2-16, but most preferably 2-12, and including, for example, pyridyl, pyrazyl, imidazolyl, and pyrrolidyl). These substituents may be substituted with any of the other substituents. Further, these substituents may be bonded to form a ring.

Y may further have a substituent. Listed as an example of the substituents are those described in JP-A No. 2004-21068. Reasons that development is activated via the use of heat solvents are assumed to be that the heat solvents melt at the temperature near the development temperature to result in compatibility with substances involved in development, whereby it is possible to perform reaction at a lower temperature than the case in the absence of heat solvents. Since the heat development is a reduction reaction in which relatively high polar carboxylic acids and silver ion transport bodies are involved, it is preferable that a reaction field exhibiting appropriate polarity, via heat solvents having a polar group, is formed.

The melting point of heat solvents, preferably employed in the present invention, is preferably 50-200° C., but is more preferably 60-150° C. Specifically, in silver salt photothermographic materials in which stability for exterior environment such as image retention properties is highly required, preferred are heat solvents at a melting point of 100-150° C.

Listed as specific examples of heat solvents may be the compounds described in paragraph ⌈0017⌋ of JP-A No. 200421068, the compounds, MF-1-MF-3, MF-6, MF-7, MF-9-MF-12, and MF-15-MF-22, described in ⌈0027⌋ of U.S. Patent Publication for Public Inspection No. 2004/0025498.

In the present invention, the added amount of heat solvents is preferably 0.01-5.0 g/m$^2$, is more preferably 0.05-2.5 g/m$^2$, but is most preferably 0.1-1.5 g/m$^2$. It is preferable that the heat solvents are incorporated in the photosensitive layer. Further, the above heat solvents are employed individually or in combinations of at least two types. In the present invention, heat solvents are incorporated in a liquid coating composition, employing any of the methods in the form of a solution, an emulsion dispersion, or a minute solid particle dispersion, followed by incorporation in the photosensitive materials.

Well-known emulsification dispersion methods include a method in which dissolution is performed employing oil such as dibutyl phthalate, tricresyl phosphate, glyceryl triacetate, or diethyl phthalate, as well as auxiliary solvents such as ethyl acetate or cyclohexanone and an emulsification dispersion is mechanically prepared.

Further, listed as a method to disperse minute solid particle is a method in which heat solvent powder is dispersed into suitable media such as water, employing a ball mill, a colloid mill, a vibration ball mill, a sand mill, a jet mill, a roller mill, or ultrasonic waves. During such dispersion, employed may be a protective colloid (for example, polyvinyl alcohol), and surface active agents (for example, anionic surface active agents such as sodium triisopropylnaphthalene sulfonate (a mixture of those in which the substitution positions of three isopropyl groups differ). In the above mills, beads of such as zirconia are commonly employed as a dispersion medium, whereby Zr, dissolved out from these beads, is occasionally mixed with a dispersion, and the amount, though depending on dispersion conditions, is commonly in the range of 1-1,000 ppm. When the content of Zr in photosensitive materials is at most 0.5 mg per g of silver, no practical problems occur. It is preferable to incorporate, in a water based dispersion, antiseptics (for example, benzoisothiazolinone sodium salt).

(Antifoggants and Image Stabilizers)

It is preferable to incorporate, in any of the constituting layers of the silver salt photothermographic imaging material of the present invention, antifoggants which minimize formation of fog during storage prior to heat development, as well as image stabilizers which minimize deterioration of the image after heat development.

In silver salt photothermographic dry imaging materials of the present invention, employed may be antifoggants and image stabilizers which are disclosed in many patents with regard to the above imaging materials.

Since reducing agents having protons, such as bisphenols and sulfonamidophenols, are employed as the reducing agents according to the present invention, it is preferable to incorporate compounds capable of minimizing a silver ion reducing reaction via stabilizing the above hydrogens to inactivate the reducing agents. Further, it is preferable to incorporate compounds capable of oxidize-bleaching silver atoms or metallic silver (being silver clusters) which are formed during storage of unexposed films or developed images.

Specific examples of compounds which exhibit the above functions include biimidazolyl compounds, iodonium compounds, and compounds capable of releasing halogen atoms as an active species, described in paragraphs ⌈0096⌋-⌈0128⌋ of JP-A No. 2003-270755, the polymers having at least one of the monomer repeating units having a halogen radical releasing group, described in JP-A No. 2003-91054, and the vinylsulfones and/or β-halosulfones described in paragraph ⌈0013⌋ of JP-A No. 6-208192, as well as various antifoggants such as vinyl type restrainers having an electron attractive group and image stabilizers.

(Toners)

The silver salt photothermographic dry imaging materials of the present invention produce photographic images via a heat development process. Consequently, it is preferable that if desired, toners are incorporated in a state in which they are commonly dispersed into a (organic) binder matrix.

Examples of appropriate toners employed in the present invention are disclosed in RD 17029, as well as U.S. Pat. Nos. 4,123,282, 3,994,732, 3,846,136, and 4,021,249. Examples include the following.

Listed are imides (for example, succinimide, phthalimide, or N-hydroxy-1,8-naphthalimide); mercaptans (for example, 3-mercapto-1,2,4-triazole); phthalazinone derivatives or metal salts thereof (for example, phthalazinone, 4-(1-naphthyl)phthalazinone, 6-chlorophthalazinone, 5,7-dimethyloxyphthalazinone, or 2,3-dihydro-1,4-phthalazinedione); combinations of phthalazine with phthalic acids (for example, phthalic acid, 4-methylphthalic acid, 4-nitrophthalic acid, or tetrachlorophthalic acid); and combinations of phthalazine with at least one compound selected from maleic anhydride, phthalic acid, 2,3-naphthalenedicarboxylic acid or o-phenylenic acid derivatives and anhydrides thereof (for example, phthalic acid, 4-methylphthalic acid, 4-nitrophthalic acid, or tetrachlorophthalic anhydride). Particularly preferred toners are phthalazine or combinations of phthalazine with phthalic acids or phthalic anhydrides.

(Fluorine Based Surface Active Agents)

In the present invention, in order to improve film conveying properties in a laser imager (being a heat development apparatus) and environmental adaptation (accumulation properties in vivo), it is possible to employ fluorine based surface active agents represented by following Formula (SF), other than the aforesaid fluorine based surface active agents and fluorine based polymers used in the backing layer according to the present invention.

$$(R_f\text{-}(L)_n\text{-})_p\text{-}(Y)_m\text{-}(A)_q \qquad \text{Formula (SF)}$$

In above Formula (SF), $R_f$ represents a substituent having a fluorine atom; L represents a divalent linking group having no fluorine atom; Y represents a (p+q) valent linking group having no fluorine atom; A represents an anion or its salt; n and m each represents an integer of 0 or 1; p represents an integer of 1-3; and q represents an integer of 1-3, while when q represents 1, n and m may not simultaneously be 0.

In above Formula (SF), $R_f$ represents a substituent having a fluorine atom(s). The above substituents having fluorine atom(s) include a fluorinated alkyl group having 1-25 carbon atoms (for example, a trifluoromethyl group, a trifluoroethyl group, a perfluoromethyl group, a perfluorobutyl group, a perfluorooctyl group, a perfluorododecyl group, and a perfluorooctadecyl group) or a fluorinated alkenyl group (for example, a perfluoropropenyl group, a perfluorobutenyl group, a perfluorononenyl group, and a perfluorododecenyl group). $R_f$ preferably has 2-8 carbon atoms, but more preferably has 2-6 carbon atoms. Further, $R_f$ preferably has 2-12 fluorine atoms, but more preferably has 3-12 fluorine atoms.

L represents a divalent linking group having no fluorine atom. Examples of the above divalent linking group having no fluorine atom include an alkylene group (for example, a methylene group, an ethylene group, or a butylene group); an alkyleneoxy group (for example, a methyleneoxy group, an ethyleneoxy group, or a butyleneoxy group); an oxyalkyelene group (for example, an oxymethylene group, an oxyethylene group, or an oxybutylene group); an oxyalkyleneoxy group (for example, an oxymethyleneoxy group, an oxyethyleneoxy group, or an oxyethyleneoxyethyleneoxy group); a phenylene group, an oxyphenylene group, a phenyloxy group, and an oxyphenyloxy group, as well as a group of combinations of these groups.

"A" represents an anionic group or its salts. Examples include a carboxylic acid group or its salts (such as sodium salt, potassium salt, or a lithium salt), a sulfonic acid group or its salts (such as a sodium salt, potassium salt, or lithium salt), a sulfuric acid half-ester group or its salts (such as sodium salt, potassium salt, or lithium salt), and phosphoric acid group or its salts (such as sodium salt or potassium salt).

"Y" represents a (p+q) valent linking group having no fluorine atom). Examples of a trivalent or tetravalent linking group having no fluorine atom include a group of atoms which are structured so that either a nitrogen atom or a carbon atom is centered, while n1 represents 0 or 1, but is preferably 1.

The fluorine based surface active agents represented by Formula (SF) are prepared as follows. Alkyl compounds (for example, compounds having a trifluoromethyl group, a pentafluoroethyl group, a perfluorobutyl group, a perfluorooctyl group, or a perfluorooctadecyl group) having 1-2 carbon atoms into which fluorine atoms have been introduced, and alkenyl compounds (for example, a perfluorohexenyl group or a perfluorononenyl group) are subjected to addition reaction or condensation reaction with tri- to hexavalent alkanol compounds, neither of which is subjected to fluorine atom introduction, and aromatic compounds or hetero-compounds having 3-4 hydroxyl groups. Subsequently, the resulting compound is subjected to introduction of anionic group (A) via, for example, sulfuric acid esterification, whereby the targeted compound is prepared.

Listed as tri- to hexavalent alkanol compounds are glycerin, pentaerythritol, 2-methyl-2-hydroxymethyl-1,3-propanediol, 2,4-hydroxy-3-hydroxymethylpentane, 1,2,6-hexanetriol, 1,1,1-tris(hydroxymethyl)propane, 2,2-bis(butanol)-3, aliphatic triol, tetramethylolmethane, xylitol, and D-mannitol.

Further, listed as the above compounds and hetero-compounds having 3-4 hydroxyl groups are 1,3,5-trihydroxybenzene and 2,4,6-trihydroxypyridine.

Specific examples of the preferred fluorine based surface active agents represented by Formula (SF) are cited below.

SF-1

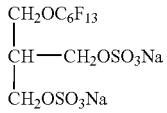

SF-2

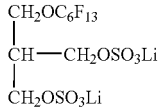

SF-3

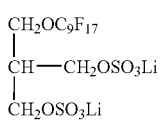

SF-4

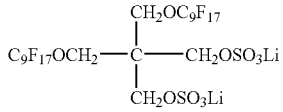

SF-5

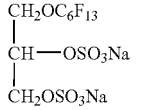

SF-6

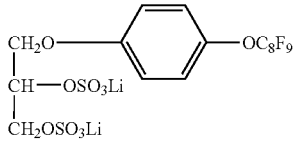

SF-7

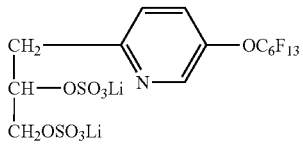

-continued

SF-8

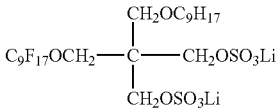

SF-9

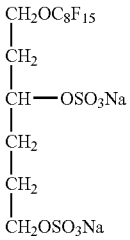

SF-10

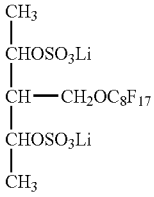

SF-11

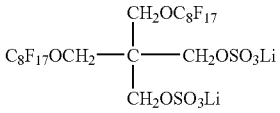

SF-12

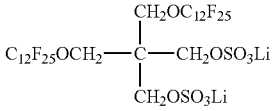

SF-13

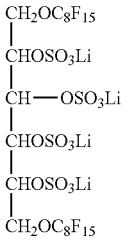

SF-14

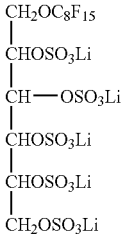

SF-15

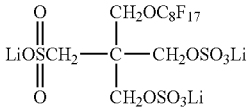

SF-16

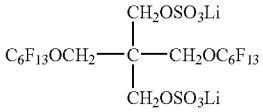

SF-17

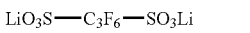

-continued

SF-18

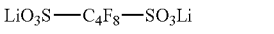

SF-19

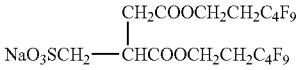

SF-20

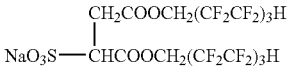

SF-21

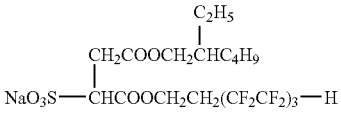

It is possible to incorporate the fluorine based surface active agents represented by above Formula (SF) into a liquid coating composition, employing any of the addition methods known in the art. Namely, it is possible to conduct addition upon dissolving them in alcohols such as methanol or ethanol, ketones such methyl ethyl ketone or acetone or polar solvents such as dimethylsulfoxide or dimethylformamide. Further, they may be dispersed into water or organic solvents to form minute particles at a size of at most 1 μm, employing sand mill dispersion, jet mill dispersion, or ultrasonic homogenizer dispersion. Many techniques are disclosed to produce minute particles, and it is possible to achieve dispersion based on those. It is preferable that the fluorine based surface active agents represented by Formula (SF) are incorporated in the protective layer of the outermost layer.

The addition amount of the fluorine based surface active agents represented by above Formula (SF) is preferably $1\times10^{-8}$-$1\times10^{-1}$ mol per $m^2$ of the imaging materials, but is most preferably $1\times10^{-5}$-$1\times10^{-2}$. When the addition amount is less than the lower limit, it is occasionally not possible to achieve the desired static properties, while when it exceeds the upper limit, humidity dependence increases whereby retention properties under high humidity are occasionally degraded.

(Surface Layer and Physical Surface Property Controlling Agents)

The silver salt photothermographic dry imaging materials of the present invention are frequently adversely affected by contact with various apparatuses and contact between the front and rear sides during winding, unwinding, and conveyance in each production process such as coating, drying and packaging. Examples include the formation of scratches and sliding abrasion on the surface of silver salt photothermographic dry imaging materials, as well as degradation of conveying properties in the processing apparatus of silver salt photothermographic dry imaging materials.

Consequently, in the silver salt photothemographic dry imaging materials of the present invention, in order to minimize their surface abrasion or degradation of conveying properties, it is possible to control physical surface properties of by incorporating matting agents known in the art in any of the constituting layers of the aforesaid materials, especially in the outermost layer on the support, together with the solid organic lubricant particles according to the present invention, whereby it is possible to control the physical surface properties of the aforesaid photosensitive materials.

(Dyes and Pigments)

In the present invention, in order to control the amount of light or the wavelength distribution of light which is transmitted to the photosensitive layer, it is preferable to form a filter layer on the same side of the photosensitive layer or on the opposite side, or to incorporate dyes or pigments in the photosensitive layer.

When employing dyes, it is possible to employ dyes, known in the art, which absorb light in various wavelength regions in response to spectral sensitivity.

For example, when preparing the silver salt photothermographic dry imaging materials of the present invention which are applied to infrared radiation, it is preferable to employ squarylium dyes having a thiopyrilium nucleus (also called thiopyrilium-squarylium dyes) and squarylium dyes having a pyrilium nucleus (also called pyrilium-squarylium dyes) disclosed in JP-A No. 2001-83655, or thiopyrilium-chroconium dyes or pyrilium-chroconium dyes which are analogous to the squarylium dyes.

Compounds having the squarylium nucleus, as described herein, refer to compounds which have 1-cyclobutene-2-hydroxy-4-one in the molecular structure. Herein, the hydroxyl group may dissociate. Also preferred as dyes are the compounds described in JP-A No. 8-210959.

(Supports)

Components of supports employed in the silver salt photothermographic dry imaging materials of the present invention include various type of polymer materials, glass, wool fabrics, cotton fabric, paper, and metal (such as aluminum), but in view of handling as information recording materials, appropriate are those which can be converted to flexible sheets and rolls. Accordingly, preferred as a support in the photothermographic dry imaging materials of the present invention are plastic films such as cellulose acetate film, polyester film, polyethylene terephthalate (PET) film, polyethylene naphthalene (PEN) film, polyamide film, polyimide film, cellulose triacetate film (TAC), or polycarbonate (PC) film. Particularly preferred is biaxially oriented PET film. The thickness of supports is commonly about 50-about 300 μm, but is preferably 70-180 μm.

In order to improve electrostatic properties, it is possible to incorporate conductive compounds such as metal oxides and/or conductive polymers in the constituting layers. The above conductive compound may be incorporated in any of the layers, but are preferably incorporated in the backing layer, or the surface protective layer on the photosensitive layer side. The conductive compounds described in columns 14-20 of U.S. Pat. No. 5,244,772 are preferably employed. Of these, in the present invention, it is preferable to incorporate conductive metal oxides in the surface protective layer on the backing layer side.

Conductive metal oxides, as described herein, refer to crystalline metal oxide particles in which those which incorporate oxygen defects and incorporate foreign atoms in a small amount, which form donors with respect to the employed metal oxides, are particularly preferred due to the resulting high electric conductivity. Specifically, the latter is particularly preferred since no fogging results in the silver halide emulsion. Examples of preferred metal oxides include ZnO, $TiO_2$, $SnO_2$, $Al_2O_3$, $In_2O_3$, $SiO_2$, MgO, BaO, $MoO_3$, and $V_2O_5$, as well as composite oxides thereof. Of these, ZnO, $TiO_2$, and $SnO_2$ are particularly preferred. Examples of incorporation of foreign atoms which result in desired effects include the incorporation of Al and In in ZnO, the incorporation of Nb, P, or a halogen atom in $SnO_2$, or the incorporation of Nb or Ta in $TiO_2$. The addition amount of such foreign atoms is preferably in the range of 0.01-30 mol percent, but is most preferably in the range of 0.1-10 mol percent. Further, in order to improve minute particle dispersibility and transparency, silicon compounds may be incorporated during preparation of minute particles.

Minute metal oxide particles employed in the silver salt photothermographic dry imaging materials of the present invention exhibit electric conductivity, and their volume resistivity is at most $10^7$ Ω·cm, but is specifically at most $10^5$ Ω·cm. such oxides are described in JP-A Nos. 56-143431, 56-120519, and 58-626647. Further, as described in Japanese Patent Publication No. 59-6235, employed may be other crystalline metal oxide particles and electrically conductive components prepared by allowing the above metal oxides to adhere to fibrous materials (such as titanium oxide).

A usable particle size is preferably at most 1 μm, but when it is at most 0.5 μm, the resulting particles are more easily handled due to better stability after dispersion. Further, in order to minimize light scattering, it is very preferable to employ conductive particles at a size of at most 0.3 μm since it is thereby possible to prepare photosensitive materials resulting in high transparency. Further, when conductive metal oxides are needle-shaped or fibrous, it is preferable that the length is at most 30 μm and the diameter is at most 1 μm. But, it is most preferable that the length is at most 10 μm, the diameter is at most 0.3 μm, and the ratio of length/diameter is at least 3. $SnO_2$ is marketed from Ishihara Sangyo Co., Ltd., and it is possible to use SNS10M, SN-100P, SN-100D, or FSS10M.

(Constituting Layers)

The silver salt photothermographic dry imaging material of the present invention incorporates a support having thereon at least one photosensitive layer. Though the photosensitive layer is only formed on the support, it is preferable that at least one non-photosensitive layer is formed on the photosensitive layer. For example, it is preferable that a protective layer is provided on the photosensitive layer to protect it.

Binders employed in the protective layer are selected from the aforesaid binders such as cellulose acetate, cellulose acetate butyrate, or cellulose acetate propionate, which exhibit a higher glass transition point (Tg) than the photosensitive layer, and desired abrasion and deformation resistance.

Further, in order to control the resulting gradation, at least two photosensitive layers may be provided on one side of the support or at least one layer may be provided on each side of the support.

(Coating of Constituting Layers)

It is preferable that the silver salt photothermographic dry imaging materials of the present invention are prepared as follows. Liquid coating compositions are prepared by dissolving or dispersing, in solvents, the components of each of the constituting layers as described above; a plurality of these liquid coating compositions is simultaneously multilayer-coated; and is subsequently thermally processed. "A plurality of these liquid coating compositions is simultaneously multilayer-coated", as described herein, means that the liquid coating composition of each of the constituting layers (for example, a photosensitive layer and a protective layer) is prepared, and during applying these onto a support, for each layer, coating and drying are not individually repeated, but it is possible to form each constituting layer in such a state that simultaneous multilayer coating is performed and the drying process is also simultaneously performed. Namely, an upper layer is applied before the amount of the total residual solvents in the lower layer reaches preferably at most 70% by weight (more preferably at most 90% by weight).

Simultaneous multilayer coating methods of each of the constituting layers are not particularly limited, and it is possible to employ methods known in the art, such as a bar coating method, a curtain coating method, a dip coating method, an air knife coating method, a hopper coating method, a reverse roller coating method, a gravure coating method, a slide coating method, or an extrusion coating method.

Of the various coating methods above, more preferred are the slide coating method and the extrusion coating method. The above coating methods, as described above, are for the photosensitive layer side. However, in the case of providing a backing layer and coating together with subbing, the above is similarly applied. Simultaneous multilayer coating methods of photothermographic dry imaging materials are detailed in JP-A No. 2000-15173.

In the present invention, it is preferable to select a suitable coated silver amount to achieve targets of each of the silver salt photothermographic dry imaging materials. In the case of targeted formation of medical images, the coated silver amount is preferably 0.3-1.5 g/m$^2$, but is more preferably 0.5-1.5 g/m$^2$. Of the above coated silver amount, the amount derived from silver halide is preferably 2-18 percent with respect to the total silver amount, but is more preferably 5-15 percent.

Further, in the present invention, the coating density of silver halide grains at a size of at least 0.01 μm (being a sphere equivalent diameter) is preferably $1\times10^{14}$-$1\times10^{18}$ partcles/m$^2$, but is more preferably $1\times10^{15}$-$1\times10^{17}$ particles/m$^2$.

Further, the coating density of the aforesaid non-photosensitive silver long chain aliphatic carboxylates is preferably $1\times10^{-17}$-$1\times10^{-14}$ g/silver halide grain at a size of at least 0.01 μm (being a sphere equivalent diameter), but is more preferably $1\times10^{-16}$-$1\times10^{-15}$.

When coating is performed under conditions within the above ranges, in view of the optical maximum density of sliver images per definite coated silver amount, namely the covering power, and silver image tone, preferred results are obtained.

In the present invention, it is preferable that the silver salt photothermographic dry imaging material incorporates solvents in the amount range of 5-1,000 mg/m$^2$ during development, but it is more preferable to control the amount to be 10-150 mg/m$^2$, whereby the silver salt photothermographic dry imaging material results in higher photographic speed, lower fogging, and higher maximum density. Listed as solvents are those described in paragraph [0030] of JP-A No. 2001-264930, however solvents are not limited thereto. Further, these solvents may be employed individually or in combinations of several types.

Further, it is possible to control the content of the above solvents in the silver salt photothermographic material by changing temperature conditions during the drying process after coating. It is possible under appropriate conditions to determine the content of the above solvents, employing gas chromatography to detect the incorporated solvents.

(Techniques to Minimize Unpleasant Odors and Stain)

Preferable embodiments will now be described as techniques to reduce or minimize unpleasant odors, and staining due to volatilization of low molecular weight compounds from the above materials in a heat development apparatus (such as a laser imager) during heat development of the silver salt photothermographic dry imaging materials of the present invention.

It is preferable that in the silver salt photothermographic dry imaging materials, the protective layer functions so that pollutants generated during heat development are not vaporized from the aforesaid materials nor to adhere to the exterior. In order to achieve the above, the binders of the protective layer are of polymers composed of cellulose acetate at an acetylation ratio of 50-58 percent, and polyvinyl alcohol units at a saponification ratio of at most 75 percent. Particularly, preferred are vinyl acetate polymers and polyvinyl alcohol.

Preferred as cellulose acetates are those at an acetylation ratio of 50-58 percent, while preferred as polyvinyl alcohol is low crystalline polyvinyl alcohol at a saponification ratio of at most 75 percent. The lower limit saponification ratio is preferably 40%, but is more preferably 60%.

Further, it is possible to employ, in the protective layer, for example, the polymers described in U.S. Pat. Nos. 6,352,819, 6,352,820 and 6,350,561, which may be blended with the above polymers. The ratio is preferably 0-90 percent by volume, but is more preferably 0-40 percent by volume.

Preferred as crosslinking agents of the above binders are isocyanate based compounds, silane compounds, epoxy compounds, or acid anhydrides.

Further, it is preferable that by employing acid group scavengers, the amount of substances volatilized from the aforesaid photosensitive materials during development is reduced. Listed as acid group scavengers may be the isocyanate based compounds represented by following Formula (X-1), the epoxy based compounds represented by following Formula (X-2), the phenol based compounds represented by following Formula (X-3), and the amine based, diamine based, and carbodiimide based compounds represented by following Formula (X-4).

Formula (X-1)

Formula (X-2)

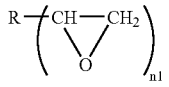

Formula (X-3)

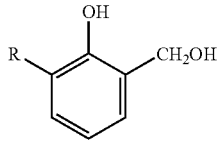

Formula (X-4)

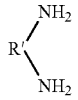

In above Formulas (X-1)-(X-4), R represents a substituent; R' represents a divalent linking group; and n represents 1-4.

(Exposure Conditions)

In regard to light employed for exposure to the silver salt photothermographic dry imaging materials of the present invention, or exposure in the image forming method of the present invention, it is possible to use various conditions of light sources and exposure time which are appropriate to obtain aimed images.

When images are recorded on the silver salt photothermographic dry imaging materials of the present invention, it is preferable to employ laser beams. Further, in the present invention, it is preferable to employ a light source which is adequate for spectral sensitivity capable of the aforesaid photosensitive materials. For example, when the aforesaid photosensitive materials are prepared to be sensitive to infrared radiation, any of the light sources are usable within the infrared region. Upon considering that a laser power is a high power, and it is possible to make silver salt photothermographic dry imaging materials transparent, infrared semiconductor lasers (at 780 nm and 820 nm) are more preferably employed.

Further, the photothemographic dry imaging materials of the present invention exhibit characteristics when exposed to high illumination intensity light of a light amount of preferably at least 1 $mW/mm^2$ for a short period of time. Illumination intensity, as described herein, refers to realization of an optical density of 3.0 after heat development. When such high illumination intensity exposure is conducted, the light amount (illumination intensity×exposure time) decreases, whereby it is possible to design a high photographic speed system. The light amount is more preferably 2-50 $mW/mm^2$, but is most preferably 10-50 $mW/mm^2$.

Any of the light sources described above may be employed, while targets are preferably realized employing lasers. Preferably employed as lasers for the photosensitive materials of the present invention are gas lasers (Ar, Kr, or He—Ne), YAG lasers, dye lasers, and semiconductor lasers. Further, it is possible to employ semiconductor lasers together with second harmonic generation elements. Still further, it is possible to employ semiconductor lasers (exhibiting a peak intensity of wavelength 350-440 nm) of blue-violet emission. Listed as a high output semiconductor laser of blue-violet emission may be NLHV 3000E semiconductor laser, a product of Nichia Corporation.

In the present invention, it is preferable that exposure is performed employing laser scanning exposure, and employed as the above exposure method may be various methods. Listed as the first preferable method is one in which a laser scanning exposure device is employed in which the angle of the exposure surface of the photosensitive material to the scanning laser beam does not become substantially perpendicular.

"Does not become substantially perpendicular", as described herein, means that the nearest angle to perpendicular is preferably 55-88 degrees, is more preferably 65-84 degrees, but is most preferably 70-82 degrees.

When a laser beam is employed to scan a photosensitive material, the beam spot diameter on the exposure surface of the photosensitive material is preferably at most 200 μm, but is more preferably at most 100 μm. The smaller spot diameter is preferred in view of decreasing the "shifting angle" from the perpendicular of the laser beam incident angle. The lower limit of the laser beam spot diameter is 10 μm. By performing such laser scanning exposure, it is possible to minimize image degradation due to reflection light such as formation of interference fringe shaped unevenness.

Further, as another method, it is preferable to perform exposure employing a laser scanning exposure device, which emits scanning laser beams of longitudinal multi. Compared to scanning laser beams of a longitudinal single mode, image gradation due to interference fringe shaped unevenness is decreased. In order to result in the longitudinal multi, methods are preferred in which return light due to the combined waves are utilized, or high frequency superimposition is conducted. Longitudinal multi, as described herein, means that the exposure wavelength is not a single value. The distribution of exposure wavelength is commonly at least 5 nm, but is preferably at least 10 nm. The upper limit of the distribution of the exposure wavelength is not particularly specified, but is commonly about 60 nm.

Still further, as the third embodiment, it is preferable to form images via scanning exposure by employing at least two laser beams. Such an image recording method employing a plurality of laser beams is a technique employed in the image writing means in laser printers or digital copiers in which the image is written by a plurality of lines via a single scan to meet the requirements of higher resolving power and higher production rate. Examples of such techniques are disclosed in JP-A No. 60-16691. In this method, a laser beam emitted from the radiation source is deflected by a polygonal mirror and scanned, and focused onto a photoreceptor via an fθ lens. This is a laser scanning optical apparatus, which is in principle, the same as laser imagers.

Image focusing of laser beams onto a photoreceptor, in the image writing means of laser printers or digital copiers, is applied to the use in which an image is written as a plurality of lines via a single scanning process. Consequently, the following laser beam is focused after being shifted by one line from the focusing position of one laser beam. Specifically, two light beams are adjacent at a distance of several 10 μm on the image plane in the secondary direction, and at a printing density of 400 dpi (dpi represents the number of dots per inch, or 2.54 cm), the secondary scanning direction pitch of two beams is 63.5 μm, while at 600 dpi, it is 42.4 μm. However, being different from such a method in which a shift is performed in the secondary scanning direction equivalent to the resolving power, in the present invention, it is preferable that an image is formed by concentrating at least two laser beams on the exposed surface while changing the incident angle. During this operation, it is preferable to hold the following relationship.

$$0.9\times E \leqq En\times N \leqq 1.1\times E$$

wherein E represents the exposure energy on the exposed surface when ordinary one laser beam is employed for writing, and En represents the exposure energy on the exposed surface when N laser beams, each of which has the same wavelength (at wavelength λ in nm) and the same exposure energy are employed for writing. In such a manner, energy on the exposed surface is assured and reflection of each laser beam on the photosensitive layer is decreased due to the low exposure energy of the laser beam, whereby formation of interference fringes is retarded.

As noted above, a plurality of laser beams employed exhibits the same wavelength λ, but beams exhibiting different wavelengths may also be employed. In such a case, in respect to λ (in nm), it is preferable that the following relationship is held.

$$(\lambda-30)<\lambda 1, \lambda 2, \ldots \lambda n \leqq (\lambda+30)$$

In image recording methods of the first, second, and third embodiments described above, appropriately selected as lasers used for scanning exposure and used in response to the use may be generally well known solid lasers such as a ruby laser, a YAG laser, or a glass laser; gas lasers such as a He—Ne laser, an argon ion laser, a $CO_2$ laser, a CO laser, a He—Cd laser, an $N_2$ laser, or an excimer laser; semiconductor lasers such as an InGaP laser, an AlGaAs laser, a GaAsP laser, an InGaAs laser, an InAsP laser, a $CdSnP_2$ laser, or a GaSb laser; chemical lasers; and dye lasers. Of these, in view of maintenance and the overall size of light sources, it is preferable to employ laser beams emitted by semiconductor lasers in the wavelength of 600-1,200 nm. In the lasers employed in laser imagers and laser image setters, when scanning is applied on silver salt photothermographic dry imaging materials, the beam spot diameter of the exposed surface of the above material is commonly in the range of 5-75 μm as a secondary axis diameter, and in the range of 5-100 μm as a primary axis diameter. It is possible to set the laser beam scanning rate at the optimal value for each of the photothermographic dry imaging materials based on the photographic speed and laser power at the laser oscillation wavelength.

(Laser Imagers and Development Conditions)

The laser imager (being the heat development apparatus), as described in the present invention, is composed of a film feeding unit represented by a film tray, a laser image recording unit, and a heat development unit which provides heat uniformly and stably onto the entire surface of a silver salt photothermographic dry imaging material, and a conveying unit which discharges, to the exterior of the apparatus, the photothermographic dry imaging materials which have been subjected imager formation via thermal development through the above units.

In order to realize quick processing, it is preferable to decrease the time interval between exposure and heat development. Further, it is preferable to simultaneously conduct exposure and heat development. Namely, in order that while exposing a part of the silver salt photothermographic dry imaging sheet material to light, the exposed portion of the sheet is initiated to development, it is preferable that the distance between the exposure section which performs exposure and the development section is 1-50 cm, whereby the processing time of a series of exposure and development is markedly shortened. The above distance is more preferably in the range of 3-40 cm, but is most preferably 5-30 cm.

The exposure section, as described herein, refers to the location within the apparatus at which light from the exposure light source is exposed onto a silver salt photothermographic dry imaging material, while the development section, as described herein, refers to the location within the apparatus at which the above silver salt photothermographic dry imaging material is initially heated for heat development.

The conveying rate in the heat development section of silver salt photothermographic dry imaging materials is commonly 20-200 mm/second, but in view of enabling efficient realization of targeted effects, the above conveying rate is preferably at least 30 mm/second, but is more preferably 30-150 mm/second. By controlling the conveying rate within the above range, it is possible to maintain even density during heat development. Further, since it is possible to shorten the processing time, it is preferably for emergency diagnoses.

Development conditions of silver salt photothermographic imaging materials vary depending on the employed devices and apparatuses, or the methods, but typically, photothermographic dry imaging materials imagewise exposed are developed after being heated to an appropriate high temperature. The development temperature is commonly about 80-about 200° C., is preferably about 100-about 140° C., but is more preferably 110-130° C., while the development time is preferably 3-20 seconds, but is more preferably 5-12 seconds.

The silver salt photothermographic dry imaging materials of the present invention is exposed through a wedge and developed at a heating temperature of 120° C. for a development time of 12 seconds. Subsequently, a characteristic curve is prepared employing rectangular coordinates in which the diffuse density (being the Y coordinate) and the common logarithms exposure amount (being the X coordinate) are used while both unit lengths are the same. The average gradient, determined based on the resulting characteristic curve, is preferably 2.0-4.0 between the optical densities determined under diffused light of 0.25 and 2.5. By controlling the gradient to the above value, it is possible to prepare images resulting in highly accurate diagnosis.

EXAMPLES

The present invention will now be more specifically described with reference to examples, however the present invention is not limited thereto. Incidentally, "parts" or "%" as employed in the examples, represent "parts by weight" or "% by weight", respectively, unless otherwise noted.

<<Preparation of Silver Salt Photothermographic Dry Imaging Materials>>

Both sides of a biaxially oriented polyethylene terephthalate film of a blue dye density of 0.135 were subjected to corona discharge treatment under conditions of 10 $W/m^2$·minute. Subsequently, the backing layer side lower subbing layer liquid coating composition, described below, was applied onto one side to realize a dried layer thickness of 0.06 μm and dried at 140° C. Thereafter, the backing layer side upper subbing layer liquid coating composition, described below, was applied to realize a dried layer thickness of 0.2 μm, and also dried at 140° C. Further, the photosensitive layer side lower subbing layer liquid composition, described below, was applied onto the opposite side to result in a dried layer thickness of 0.25 μm, and subsequently, the photosensitive layer upper subbing layer liquid coating composition, described below, was applied onto the above coating to realize a dried layer thickness of 0.06 μm, and also dried at 140° C. The resulting coating was subjected to heat treatment at 140° C. for two minutes, whereby a subbed sample was prepared.

| (Backing Layer Side Lower Subbing Layer Liquid Composition) | |
|---|---|
| Copolymer latex of styrene/glycidyl methacrylate/butyl acrylate (20/20/40) (30% solids) | 16.0 g |
| Copolymer latex of styrene/butyl acrylate/hydroxymethyl methacrylate (25/45/30) (30% solids) | 4.0 g |
| $SnO_2$ sol (10% solids, synthesized employing the method described in JP-A No. 10-059720) | 91.0 g |
| Surface Active Agent A | 0.5 g |

Distilled water was added to the above composition to bring the total to 1,000 ml, whereby a liquid coating composition was prepared.

Surface Active Agent A

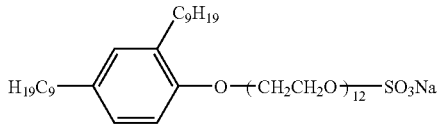

| (Backing Layer Side Upper Subbing Layer Liquid Coating Composition) | |
|---|---|
| Modified Aqueous Polyester A (18% solids) | 215.0 g |
| Surface Active Agent A | 0.4 g |
| Spherical silica matting agent (SEAHOSTER KE-P50, produced by Nippon Shokubai Co., Ltd.) | 0.3 g |

Distilled water was added to the above composition to bring the total to 1,000 ml, whereby a liquid coating composition was prepared.

<Synthesis of Modified Aqueous Polyester A)

Charged into a polymerization reaction vessel were 35.4 parts of dimethyl terephthalate, 33.63 parts of dimethyl isophthalate, 17.92 parts of dimethyl 5-sulfo-isophthalate sodium salt, 62 parts of ethylene glycol, 0.65 part of calcium acetate monohydrate, and 0.022 part of manganese acetate tetrahydrate. Under a nitrogen flow, while distilling out methanol at 170-220° C., transesterification was performed. Thereafter, 0.04 part of trimethyl phosphate, 0.04 part of antimony trioxide, and 6.8 parts of 4-cyclohexanedicarboxylic acid were added, and esterification was performed at 220-235° C. upon distilling out nearly the theoretical amount of water. Then, the pressure in the reaction system was reduced over one hour upon being heated, and finally, polycondensation was performed at 280° C. under a pressure of at most 133 Pa over about one hour, whereby a precursor of Modified Aqueous Polyester A was prepared. The intrinsic viscosity of the precursor was 0.33.

Charged into a 2 L three-necked flask fitted with stirring blades, a reflux cooling pipe and a thermometer was 850 ml of pure water, and while rotating the stirring blades, 150 g of the above precursor was gradually added. After stirring the resulting mixture at room temperature for 30 minutes, the interior temperature was raised to 98° C. over one hour, and dissolution was carried out at the above temperature over three hours. After heating, the resulting solution was cooled to room temperature over one hour and was allowed to stand overnight, whereby a precursor solution at a solid concentration of 15% by weight was prepared.

Charged into a 3 L four-necked flask fitted with stirring blades, a reflux cooling pipe, a thermometer, and a dripping funnel was 1,900 ml of the above precursor solution, and while rotating stirring blades, the interior temperature was raised to 80° C. and 6.52 ml of a 24% aqueous ammonium peroxide solution was added. Subsequently, added to the resulting mixture was a monomer mixture (consisting of 28.5 g of glycidyl methacrylate, 21.4 g of ethyl acrylate, and 21.4 g of methyl methacrylate) over 30 minutes and reaction was performed for an additional three hours. Thereafter, the temperature was lowered to 30° C. and filtration was performed, whereby Modified Aqueous Polyester A Solution at a solid concentration of 10% was prepared.

| (Photosensitive Layer Side Lower Subbing Layer Liquid Coating Composition) | |
|---|---|
| Copolymer latex of styrene/acetacetoxyethyl methacrylate/glycidyl methacrylate/n-butyl acrylate (40/40/20/0.5) (30% solids) | 70 g |
| Surface Active Agent A | 0.3 g |

Distilled water was added to the above composition to bring the total to 1,000 ml, whereby a liquid coating composition was prepared.

| (Photosensitive Layer Side Upper Subbing Layer Liquid Coating Composition) | |
|---|---|
| Modified Aqueous Polyester B (18% solids) | 80.0 g |
| Surface Active Agent A | 0.4 g |
| Spherical silica matting agent (SEAHOSTER KE-P50, produced by Nippon Shokubai Co., Ltd.) | 0.3 g |

Distilled water was added to the above composition to bring the total to 1,000 ml, whereby a liquid coating composition at a solid concentration of 0.5% was prepared.

<Synthesis of Modified Aqueous Polyester B>

A Modified Aqueous Polyester B solution was prepared in the same manner as Modified Aqueous Polyester A, except that the precursor solution was changed to 1,800 ml and the composition of the monomer mixture was changed to 31 g of styrene, 31 g of acetacetoxyethyl methacrylate, 61 g of glycidyl methacrylate, and 7.6 g of n-butyl acrylate.

| (Preparation of Silver Halide Emulsion) | |
|---|---|
| (Solution A1) | |
| Phenylcarbamoylated gelatin | 66.2 g |
| Compound A (*1) (10% aqueous solution) | 10 ml |
| Potassium bromide | 0.32 g |
| Water to make | 5429 ml |
| (Solution B1) | |
| 0.67 mol/L aqueous silver nitrate solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| Potassium iron(II) hexacyanide (0.5% aqueous solution) | 15 ml |
| Potassium iridium (III) hexachloride (1.0% aqueous solution) | 0.93 ml |
| Water to make | 1982 ml |
| (Solution E1) | |
| 0.4 mol/L aqueous potassium bromide solution | amount to realize the following silver potential |
| (Solution F1) | |
| Potassium hydroxide | 0.71 g |
| Water to make | 20 ml |
| (Solution G1) | |
| 56% aqueous acetic acid solution | 10.0 ml |
| (Solution H1) | |
| Sodium carbonate anhydride | 1.16 g |
| Water to make | 107 ml |

(*1) Compound A: $HO(CH_2CH_2O)_n(CH(CH_3)CH_2O)_{17}(CH_2CH_2O)_mH$ (m + n = 5 − 7)

By employing the mixer described in Japanese Patent Publication No. 58-58288, added to Solution A1 were ¼ of Solution B1 and all Solution C1 over 4 minutes and 45 seconds, employing a double-jet method controlled to 35° C. and a pAg to 8.09, whereby nuclei were formed. After one minute, all Solution F1 was added. During the addition, the pAg was appropriately controlled employing Solution E1. After an elapse of 6 minutes, ¾ of Solution B1 and all Solution D1 were added over 14 minutes and 15 seconds, employing a double-jet method controlled to 35° C. and a pAg to 8.09. After stirring for 5 minutes, the temperature was lowered to 30° C. and all Solution G1 was added, whereby a silver halide emulsion was precipitated. The supernatant was removed to leave 2,000 ml of the precipitated portion, and 10 L of water was added. After stirring, the silver halide emulsion was re-precipitated, and 1,500 ml of the precipitated portion was left and the supernatant was removed. Subsequently, 10 L of water was added and stirring was conducted. Thereafter, the silver halide emulsion was re-precipitated, and while leaving 1,500 ml of the precipited portion, the supernatant was removed and 10 L of water was further added. After stirring, the silver halide emulsion was precipitated. While leaving 1,500 ml of the precipitated portion, the supernatant was removed. Thereafter, Solution H1 was added and the resulting mixture was heated to 60° C. and stirred for an additional 120 minutes. Finally, the pH was adjusted to 5.8 and water was added to realize 1,161 g per mol of silver, whereby Silver Halide Emulsion 1 was prepared.

Silver halide grains in Silver Halide Emulsion 1, prepared as above, were monodispersed cubic silver iodobromide grains at an average sphere equivalent diameter of 0.043 μm and a [100] plane ratio of 92%.

(Preparation of Organic Silver Salt Powder A)

Dissolved at 80° C. in 4,720 ml of pure water were 130.8 g of behenic acid, 67.7 g of arachidinic acid, 43.6 g of stearic acid, and 2.3 g of palmitic acid. Subsequently, 540.2 ml of a 1.5 mol/L aqueous potassium hydroxide solution was added, followed by the addition of 6.9 ml of concentrated nitric acid. Thereafter, the resulting mixture was cooled to 55° C., whereby a fatty acid potassium solution was prepared. While maintaining the above fatty acid potassium solution at 55° C., 45.3 g of above Photosensitive Silver Halide Emulsion 1 and 450 ml of pure water were added and stirred for 5 minutes.

Subsequently, 702.6 ml of a 1 mol/L silver nitrate solution was added over two minutes and stirred for 10 minutes, whereby an organic silver salt dispersion was prepared. Thereafter, the resulting organic silver salt dispersion was conveyed into a water-washing vessel, to which deionized water was added. After stirring, the resulting mixture was allowed to stand and the organic silver salt dispersion was separated upon being floated, and water-soluble salts in the bottom portion were removed. Thereafter, washing was repeated employing deionized water until the conductivity of the effluent reached 2 μS/cm. After conducting centrifugal dehydration, the resulting cake form organic silver salt was dried in an ambience of nitrogen gas to realize a moisture content of 0.1%, employing an air flow type drier, FLASH JET DRIER (produced by Seishin Kikaku Co., Ltd.) under operation conditions of hot air temperature at the inlet (65° C. at the inlet and 40° C. at the outlet), whereby dried Organic Silver Salt Powder A was prepared. The moisture content of organic silver salt compositions was determined employing an infrared moisture meter.

(Preparation of Organic Silver Salt Dispersion A)

Dissolved in 1,300 g of methyl ethyl ketone was 49 g of polyvinyl butyral (ESLEX B-BL-SHP, produced by Sekisui Chemical Co., Ltd.). While stirring employing DISSOLVER DISPERMAT TYPE CA-40M, produced by VMA-GETZMANN Co., 500 g of Organic Silver Salt Powder A was added and sufficiently blended, whereby a preliminary dispersion was prepared. After adding all Organic Silver Salt Powder A, stirring was conducted at 1,500 rpm for 15 minutes. The above preliminary dispersion was supplied to media type homogenizer, DISPERMAT SL-C12EX TYPE (produced by VMA-GETZMANN Co.), loaded with 0.5 mm diameter zirconia beads (TORECERUM, produced by Toray Industries, Inc.) to 80% of the interior capacity so that the retention time in the mill reached 1.2 minutes, and dispersed at a mill peripheral rate of 9 m/second, whereby Organic Silver Salt Dispersion A was prepared. The solid concentration of resulting Organic Silver Salt Dispersion A was approximately 27%.

(Preparation of Photosensitive Layer Liquid Coating Composition, Protective Layer Liquid Coating Composition, and Backing Layer Liquid Coating Composition)

(Preparation of Photosensitive Layer Liquid Coating Composition)

Added to 1,670 g of above Organic Silver Salt Dispersion A was an equal amount of methyl ethyl ketone. While stirring and maintaining at 18° C., 12.6 g of bis(dimethylacetamido) dibromobromate (being an 11% methanol solution) was added and stirred for 30 minutes. Further, the stabilizer solution and infrared sensitizing dye solution described below were added and stirred for one hour. Thereafter, the temperature was lowered to 13° C., and stirred for an additional 30 minutes. While maintained at 13° C., 416 g of polyvinyl butyral resin powder (S-LEX B-BL-5, produced by Sekisui Chemical Co., Ltd.) was added and dissolved. After confirming the complete dissolution, 19.8 g of tetrachlorophthalic acid (being a 13% methyl ethyl ketone solution) was added, and while stirring, the following additives were added at an interval of 15 minutes, whereby a photosensitive layer liquid coating composition was prepared.

| | |
|---|---|
| Phthalazine | 12.4 g |
| DESMODUR N3300 (aliphatic isocyanate, produced by Mobay Co.) | 17.6 g |
| Antifoggant solution | described below |
| Developing agent solution | described below |

<Preparation of Infrared Sensitizing Dye Solution>

Dissolved in 135 g of methyl ethyl ketone were 300 mg of Infrared Sensitizing Dye-1, 400 mg of Infrared Sensitizing Dye-2, 130 mg of 5-methyl-2-mercaptobenzimidazole, 21.5 g of 2-chloro-benzoic acid, and 2.5 g of sensitizing dye dissolving agent, whereby an infrared sensitizing dye solution was prepared.

<Preparation of Stabilizer Solution>

Dissolved in 14 g of methanol were 0.9 g of the stabilizer, and 0.3 g of potassium acetate, whereby a stabilizer solution was prepared.

<Preparation of Developing Agent Solution>

Dissolved in methyl ethyl ketone were 120 g of the developing agent and 9 g of 4-methylphthalic acid, and the total weight was brought to 1,200 g, whereby a developing agent solution was prepared.

<Preparation of Antifoggant Solution>

Dissolved in methyl ethyl ketone was 11.6 g of tribromomethylsulfonylpyridine and the total weight was brought to 180 g, whereby an antifoggant solution was prepared.

Infrared Sensitizing Dye-1

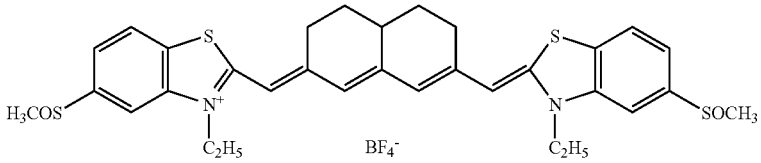

Infrared Sensitizing Dye-2

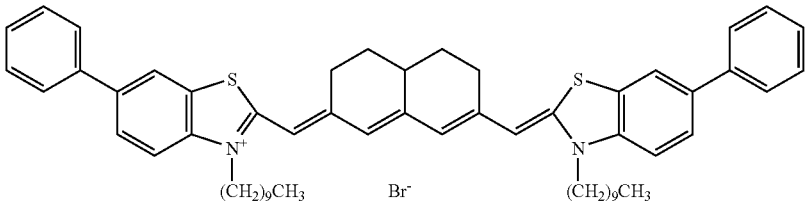

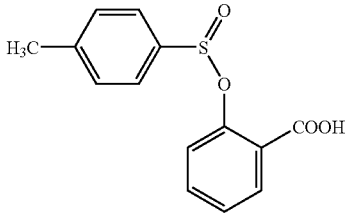

Sensitizing Dye Dissolving Agent

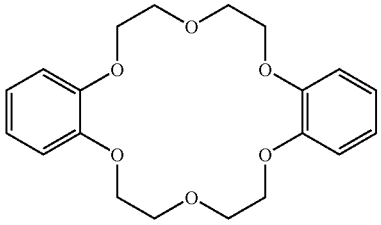

Stabilizer

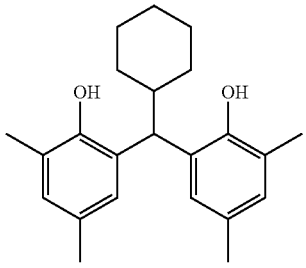

Developing Agent

| (Preparation of Protective Surface Layer Liquid Coating Composition) | |
|---|---|
| Methyl ethyl ketone | 1056 g |
| Cellulose acetate propionate (CAP141-20, produced by Eastman Chemical Co. | 148 g |
| Polymethyl methacrylate (PARALOID A21, produced by Robin and Haas Co.) | 6 g |
| Matting agent dispersion (silica of an average particle size of 4 μm at a dispersibility of 10% and a solid concentration of 1.7% | 170 g |

-continued

| | |
|---|---|
| $CH_2{=}CHSO_2CH_2CH(OH)CH_2SO_2{=}CH_2$ | 3.6 g |
| Benzimidazole | 2 g |
| $C_9F_{17}O(CH_2CH_2O)_{23}C_9F_{17}$ | 5.4 g |
| (Preparation of Backing Layer Liquid Coating Composition 1) | |
| Methyl ethyl ketone | 1350 g |
| Cellulose acetate propionate (CAP482-20, produced by Eastman Chemical Co. | 121 g |
| Dye-A | 0.23 g |
| Dye-B | 0.62 g |
| Fluorine Containing Compound ($LiO_3S(CF_2)_3SO_3Li$) | 0.85 g |
| Fluorine Based Polymer 1-1 | 1.21 g |
| 2.17% Matting Agent Dispersion 1 (*1) | 92 g |
| $C_9F_{17}O(CH_2CH_2O)_{23}C_9F_{17}$ | 5.21 g |

<*1: Matting Agent Dispersion 1>

Added to 90 g of methyl ethyl ketone was 2.0 g of boron nitride (at an average particle diameter of 6.0 μm) as inorganic solid lubricant particles. The resulting mixture was dispersed over 30 minutes, employing an ultrasonic homogenizer (under the trade name of ULTRASONIC GENERATOR, produced by ALEX Corporation at a frequency of 25 kHz and 600 W), and the resulting dispersion was designated as Matting Agent Dispersion 1.

Dye-A

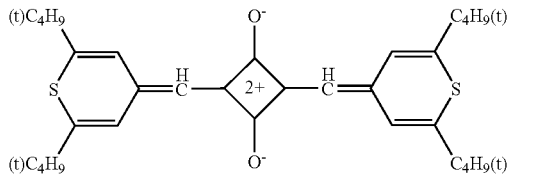

Dye-B

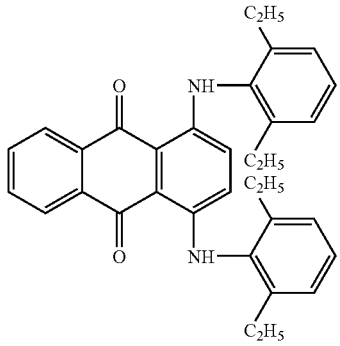

(Preparation of Heat Developable Photosensitive Material 1)

The photosensitive layer liquid coating composition was applied onto the photosensitive layer side upper subbing layer of the subbed support, prepared as above, to realize a total silver amount of 1.6 g/m$^2$, and the surface protective layer liquid coating composition was then applied thereon to result in a wet coated amount of 23 g/m$^2$. Subsequently, Backing Layer Liquid Coating Composition 1 was applied onto the backing layer side upper subbing layer on the opposite side to result in a wet coated amount of 4.2 g/m$^2$. Drying of each coating was performed at 60° C. for 15 minutes. A sample which had been coated on both sides was subjected to thermal treatment at 79° C. for 10 minutes while conveyed, whereby Heat Developable Photosensitive Material 1 was prepared.

(Preparation of Heat Developable Photosensitive Material 2)

Heat Developable Photosensitive Material 2 was prepared in the same manner as above Heat Developable Photosensitive Material 1, except that Backing Layer Liquid Coating Composition 1 was replaced with the following Backing Layer Liquid Coating Composition 2.

(Preparation of Backing Layer Liquid Coating Composition 2)

Backing Layer Liquid Coating Composition 2 was prepared in the same manner as the above Backing Layer Liquid Coating Composition 1, except that 18.2 mg of Exemplified Compound H-1 (VITEL PE2200B, produced by Bostic Co.) was added as a polyester resin, and further, Matting Agent Dispersion 1 was replaced with the following Matting Agent Dispersion 2.

<Matting Agent Dispersion 2>

Added to 90 g of methyl ethyl ketone was 0.02 g of Exemplified Compound W-11 (N-stearylstearic acid amide at a melting point of 95° C. and an average particle diameter of 5.5 μm) as inorganic solid lubricant particles and 2.0 g of SEAHOSTER P-250 (being minute silica particles at an average particle diameter of 2.5 μm, produced by Nippon Shokubai Co., Ltd.) as minute inorganic particles. The resulting mixture was dispersed over 30 minutes, employing an ultrasonic homogenizer (a trade name of ULTRASONIC GENERATOR, produced by ALEX Corporation at a frequency of 25 kHz and 600 W), and the resulting dispersion was designated as Matting Agent Dispersion 2.

(Preparation of Heat Developable Photosensitive Materials 3-8)

Each of Heat Developable Photosensitive Materials 3-8 was prepared in the same manner as the above Heat Developable Photosensitive Material 1, except that Backing Layer Liquid Coating Composition 1 was replaced with each of the following Backing Layer Liquid Coating Compositions 3-8.

(Preparation of Backing Layer Liquid Coating Compositions 3-8)

Each of Backing Layer Liquid Coating Compositions 3-8 was prepared in the same manner as the above Backing Layer Liquid Coating Composition 2, except that the type and added amount of organic solid lubricant particles, and the type and added amount of minute inorganic particles, as well as the type of polyester resins were changed as described in Table 1.

(Preparation of Heat Developable Photosensitive Materials 9-14)

Each of Heat Developable Photosensitive Materials 9-14 was prepared in the same manner as the above Heat Developable Photosensitive Material 1, except that Backing Layer Liquid Coating Composition 1 was replaced with each of the following Backing Layer Liquid Coating Compositions 9-14.

(Preparation of Backing Layer Liquid Coating Compositions 9-14)

Each of Backing Layer Liquid Coating Compositions 9-14 was prepared in the same manner as the above Backing Layer Liquid Coating Composition 2, except that the type and added amount of solid organic lubricant particles, and the type and added amount of minute inorganic/organic particles, as well as the type of polyester resins were changed as described in Table 1.

(Preparation of Heat Developable Photosensitive Material 15)

Heat Developable Photosensitive Material 15 was prepared in the same manner as the above Heat Developable Photosensitive Material 6, except that in the preparation of the surface protective layer liquid coating composition, 170 g of the matting agent dispersion (being silica of an average particle size of 4 μm at a dispersibility of 10% and a solid concentration of 1.7%) was replaced with 68 g of a matting agent dispersion (being silica of an average particle size of 4 μm at a dispersibility of 10% and a solid concentration of 1.7% and 102 g of a matting agent dispersion (being solid organic lubricant particle OW-11, N-stearylstearic acid amide at an average particle size of 5.5 μm and an average solid concentration of 1.7%).

(Preparation of Heat Developable Photosensitive Material 16)

Heat Developable Photosensitive Material 16 was prepared in the same manner as the above Heat Developable Photosensitive Material 6, except that in the preparation of the surface protective layer liquid coating composition, 170 g of the matting agent dispersion (being silica of an average particle size of 4 μm at a dispersibility of 10% and a solid concentration of 1.7%) was replaced with 68 g of a matting agent dispersion (being 3-dimensionally crosslinked polymethyl methacrylate, OMMA of an average particle size of 4 μm at a dispersibility of 10% and a solid concentration of 1.7%) and 102 g of a matting agent dispersion (being solid organic lubricant particle OW-11, N-stearylstearic acid amide at an average particle size of 5.5 μm and an average solid concentration of 1.7%).

(Preparation of Heat Developable Photosensitive Material 17)

Heat Developable Photosensitive Material 17 was prepared in the same manner as the above Heat Developable Photosensitive Material 6, except that in the preparation of the surface protective layer liquid coating composition, 170 g of the matting agent dispersion (being silica of an average particle size of 4 μm at a dispersibility of 10% and a solid concentration of 1.7%) was replaced with 68 g of a matting agent dispersion (being silica of an average particle size of 4 μm at a dispersibility of 10% and a solid concentration of 1.7%) and 102 g of a matting agent dispersion (being organic solid lubricant particle 1-6, calcium stearate at an average particle size of 1.1 μm and an average solid concentration of 1.7%).

Solid organic lubricant particles, minute inorganic particles, and polyester resins, described in Table 1. are detailed below.

OW-27: ethylenebisstearic acid amide (exhibiting a melting point of 145° C. and an average particle diameter of 7.8 μm)

PW-1: polyethylene (exhibiting a low degree of polymerization,
a melting point of 113° C., and an average particle diameter of 3.6 μm)

H-8: VYLON 240 (TOYOBO Co., Ltd.)

*A: SEAHOSTER P-250

*B: SYLYSIA 450 (minute silica particles at an average particle diameter of 8 μm, produced by Fuji Silysia Chemical Ltd.)

*C: 3-dimensionally crosslinked polymethyl methacrylate (PMMA)

*1-7: zinc stearate

<<Evaluation of Heat Developable Photosensitive Materials>>

(Determination of Dynamic Friction Coefficient)

Each of the heat developable photosensitive materials was cut into at specified sized sheets, and the resulting sheets were allowed to stand for 7 days in such a manner that the surface of the photosensitive layer came into contact with the surface of the backing layer. Thereafter, they were allowed to stand for 4 hours at 25° C. and 55% relative humidity. Subsequently, the dynamic friction coefficient of the surface of each of the backing layer and the photosensitive layer was determined employing a surface property meter, HEIDON-14, produced by Shinto Kagaku Limited.

(Evaluation of Close Contact Property (Pick-Up))

Two sheets (at a size of 10 cm×10 cm) of each of the heat developable photosensitive materials were stacked so that the surface of the photosensitive layer faced the surface of the backing layer and pressed several times so that two heat developable photosensitive materials were brought into close contact. Thereafter, the force necessary to peel the upper sample while holding the lower sample was determined employing TENSIRON, produced by ORIENTEC Co., and the recorded value was designated as a scale of the contact force. Contact force of at least 300 g resulted in pick-up problems.

(Evaluation of Conveying Properties)

The photosensitive layer of each of the samples prepared as above was subjected to scanning exposure via an optical wedge employing an exposure device which used, as a beam source, a semiconductor laser which was subjected to longitudinal multi-mode of wavelengths of 800-820 nm at high frequency superposition. During the above exposure, images were formed at an angle of 75 degrees of the exposed surface of the sample to the laser beam. In such a case, compared to the case of the above angle at 90 degrees, images which were uniform and exhibited unexpectedly sharpness were produced.

Subsequently, by employing a thermal processor fitted with a heating drum and a cooling zone (being the dry laser imager, DRYPRO 793, produced by Konica Minolta Holdings, Inc.), 100 sheets were continuously subjected to heat development treatment at the conveying rate described in Table 1 under conditions of 120° C. and 13.5 seconds while the protective layer of the sample and the drum surface were brought into contact. During this operation, exposure and development were performed under conditions of 23° C. and 50% relative humidity.

During the above 100-sheet continuous processing, the number of sheets exhibiting conveyance problems was recorded and the resulting value was employed as a scale of conveying properties. Even in the case in which only one sheet resulted in conveyance problems, all sheets were judged to be commercially unviable.

Table 1 shows the results of the above.

TABLE 1

| | Inorganic/Organic Solid Lubricant (A) | | | Minute Inorganic/Organic Particle (B) | | | | | | Individual Evaluation Result | | | |
|---|---|---|---|---|---|---|---|---|---|---|---|---|---|
| *2 | Type | *3 | Added Amount (g) | Type | *3 | Added Amount (g) | A/B Weight Ratio | Polyester Resin | *4 | Dynamic Friction Coefficient (μk) | Close Contact Force (g) | Poor Conveyance (number of sheets) | Remarks |
| 1 | boron nitride | 6.0 | 2.0 | — | — | — | — | H-1 | 32 | 0.42 | 500 | 5 | Comp. |
| 2 | OW-11 | 5.5 | 0.02 | *A | 2.5 | 2.0 | 1/99 | H-1 | 32 | 0.32 | 290 | 0 | Inv. |
| 3 | OW-11 | 5.5 | 0.02 | *A | 2.5 | 2.0 | 20/80 | H-8 | 32 | 0.30 | 200 | 0 | Inv. |
| 4 | OW-11 | 5.5 | 2.0 | *A | 2.5 | 2.0 | 50/50 | H-8 | 32 | 0.29 | 150 | 0 | Inv. |
| 5 | OW-27 | 7.8 | 2.0 | *A | 2.5 | 1.5 | 58/42 | H-8 | 32 | 0.28 | 150 | 0 | Inv. |
| 6 | OW-27 | 7.8 | 2.0 | *B | 8.0 | 1.5 | 58/42 | H-8 | 32 | 0.29 | 100 | 0 | Inv. |

TABLE 1-continued

| | Inorganic/Organic Solid Lubricant (A) | | | Minute Inorganic/Organic Particle (B) | | | | | | Individual Evaluation Result | | | |
|---|---|---|---|---|---|---|---|---|---|---|---|---|---|
| *2 | Type | *3 | Added Amount (g) | Type | *3 | Added Amount (g) | A/B Weight Ratio | Polyester Resin | *4 | Dynamic Friction Coefficient (μk) | Close Contact Force (g) | Poor Conveyance (number of sheets) | Remarks |
| 7 | OW-27 | 7.8 | 4.0 | *B | 8.0 | 1.0 | 80/20 | H-8 | 32 | 0.25 | 100 | 0 | Inv. |
| 8 | PW-1 | 3.6 | 2.0 | *B | 8.0 | 1.0 | 67/33 | H-8 | 32 | 0.24 | 100 | 0 | Inv. |
| 9 | OW-11 | 5.5 | 2.0 | *C | 7.0 | 1.0 | 67/33 | H-8 | 32 | 0.23 | 120 | 0 | Inv. |
| 10 | OW-27 | 7.8 | 2.0 | *C | 7.0 | 1.0 | 67/33 | H-8 | 32 | 0.23 | 120 | 0 | Inv. |
| 11 | PW-1 | 3.6 | 2.0 | *C | 7.0 | 1.0 | 67/33 | H-8 | 32 | 0.22 | 120 | 0 | Inv. |
| 12 | *1-7 | 3.0 | 2.0 | *A | 2.5 | 1.0 | 67/33 | H-8 | 32 | 0.25 | 160 | 0 | Inv. |
| 13 | *1-7 | 3.0 | 2.0 | *B | 8.0 | 1.0 | 67/33 | H-8 | 32 | 0.26 | 110 | 0 | Inv. |
| 14 | *1-7 | 3.0 | 2.0 | *C | 7.0 | 1.0 | 67/33 | H-8 | 32 | 0.24 | 130 | 0 | Inv. |
| 15 | OW-27 | 7.8 | 2.0 | *B | 8.0 | 1.5 | 58/42 | H-8 | 32 | 0.26 | 100 | 0 | Inv. |
| 16 | OW-27 | 7.8 | 2.0 | *B | 8.0 | 1.5 | 58/42 | H-8 | 32 | 0.26 | 100 | 0 | Inv. |
| 17 | OW-27 | 7.8 | 2.0 | *B | 8.0 | 1.5 | 58/42 | H-8 | 32 | 0.27 | 120 | 0 | Inv. |

*2: Heat Developable Photosensitive Material No.,
*3: Average Particle Diameter (μm),
*4: Conveying Rate (mm/s),
Comp.: Comparative Example,
Inv.: Present Invention
*1-7: Zinc stearate As can clearly be seen from the results shown in Table 1, the heat developable photosensitive materials of the present invention, which incorporate the backing layer constituted as specified in the present invention, exhibited a lower dynamic friction coefficient between the front surface and the rear surface (on the photosensitive layer side and on the backing layer side), and resulted in lower close contact force, compared to the comparative example, whereby no poor conveyance occurred even during a conveyance rate as high as 32 mm/second.

What is claimed is:

1. A silver salt photothermographic dry imaging material comprising a support having:

(i) a photosensitive layer comprising photosensitive silver halide grains, an organic silver salt and a reducing agent for silver ions on one side of the support; and (ii) a backing layer on a side of the support opposite the photosensitive layer, comprising:

(a) organic solid lubricant particles having an average diameter of 1.0 to 30 μm and having a melting point from 110 to 200° C.; and (b) inorganic microparticles or organic microparticles having an average diameter of 1.0 to 20 μm.

2. The silver salt photothermographic dry imaging material of claim 1, wherein the organic solid lubricant particles comprise a compound represented by Formula (1):

$$(R_1—X_1)_p\text{-L-}(X_2—R_2)_q \qquad \text{Formula (1)}$$

wherein R1 and R2 each independently represents a substituted or unsubstituted alkyl group, alkenyl group, aralkyl group, or aryl group each having 6-60 carbon atoms; p an q each independently represents an integer of 0 to 6, provided that when p or q is at least 2, a plurality of $R_1$ and $R_2$ may be the same or different; $x_1$ and $x_2$ each independently represents a divalent linking group containing a nitrogen atom, and L represents a substituted or unsubstituted alkyl group, alkenyl group, aralkyl group, or aryl group each independently having a valent of (p+q).

3. The silver salt photothermographic dry imaging material of claim 1, wherein the organic solid lubricant particles comprise a polymer compound selected from the group consisting of polyethylene, polypropylene, and polytetrafluoroethylene.

4. The silver salt photothermographic dry imaging material of claim 1, wherein the organic solid lubricant particles comprise a metal soap.

5. The silver salt photothermographic dry imaging material of claim 1, wherein the organic solid lubricant particles comprise a compound represented by Formula (2)

$$(R_1)—COO\text{-}M\text{-}OOC—(R_2) \qquad \text{Formula (2)}$$

wherein R1 and R2 each independently represents a substituted or unsubstituted alkyl group, alkenyl group, aralkyl group, or aryl group each having 6-60 carbon atoms; and M represents divalent metal atom.

6. The silver salt photothermographic dry imaging material of claim 1, wherein a weight ratio of the organic solid lubricant particles to the inorganic microparticles, or a weight ratio of the organic solid lubricant particles to the organic microparticles is between 1:99 and 99:1.

7. The silver salt photothermographic dry imaging material of claim 1, wherein a weight ratio of the organic solid lubricant particles to the inorganic microparticles, or a weight ratio of the organic solid lubricant particles to the organic microparticles is between 5:95 and 95:5.

8. The silver salt photothermographic dry imaging material of claim 1, wherein a weight ratio of the organic solid lubricant particles to the inorganic microparticles, or a weight ratio of the organic solid lubricant particles to the organic microparticles is between 50:50 and 95:5.

9. The silver salt photothermographic dry imaging material of claim 1, wherein the inorganic microparticles are porous microparticles.

10. The silver salt photothermographic dry imaging material of claim 1, wherein the inorganic microparticles are metal oxide.

11. The silver salt photothermographic dry imaging material of claim 1, wherein the inorganic microparticles are silica.

12. The silver salt photothermographic dry imaging material of claim 1, wherein the organic microparticles are polymer microparticles.

13. The silver salt photothermographic dry imaging material of claim 1, wherein the organic microparticles comprise a compound selected from a group consisting of an acrylic resin, a styrene resin, a melamine resin, and a polyurethane resin.

14. The silver salt photothermographic dry imaging material of claim 1, wherein the organic microparticles comprise polymethyl methacrylate or three-dimensionally cross-linked polymethyl methacrylate.

15. The silver salt photothermographic dry imaging material of claim 1, wherein the backing layer comprises a polyester resin.

16. The silver salt photothermographic dry imaging material of claim 1, wherein heat development is performed at a conveying rate of at least 30 mm/second.

* * * * *